US006766547B1

(12) United States Patent
Lagassey

(10) Patent No.: US 6,766,547 B1
(45) Date of Patent: Jul. 27, 2004

(54) WHEELED PATIENT STRETCHER WITH ATTENDANT PLATFORMS

(76) Inventor: Paul J. Lagassey, 11604 Palmetto Way, Cooper City, FL (US) 33026

( * ) Notice: Subject to any disclaimer, the term of this patent is extended or adjusted under 35 U.S.C. 154(b) by 0 days.

(21) Appl. No.: 10/375,862

(22) Filed: Feb. 27, 2003

(51) Int. Cl.[7] ..... A61G 13/10; A61G 13/00; A61G 13/12; A61G 7/08

(52) U.S. Cl. ..... 5/620; 5/86.1; 5/600; 5/624; 5/507.1; 5/658

(58) Field of Search ..... 5/620, 600, 624, 5/507.1, 658, 503.1, 81.1 R, 68.1

(56) References Cited

U.S. PATENT DOCUMENTS 2,445,619 A * 7/1948 Josephs ..... 5/507.1
2,524,971 A * 10/1950 Gray ..... 5/507.1
4,190,280 A 2/1980 Donohoe
4,564,965 A * 1/1986 Goodwin ..... 5/507.1
6,550,084 B2 * 4/2003 Siepmann et al. ..... 5/624

* cited by examiner

*Primary Examiner*—Alexander Grosz
(74) *Attorney, Agent, or Firm*—Malin, Haley & DiMaggio, P.A.

(57) ABSTRACT

A wheeled patient support assembly that allows a patient and at least one medical attendant to be moved while the medical attendant(s) administer medical treatment to the patient comprising a patient support surface, rolling mechanisms or other means for moving the assembly over the floor, at least one attendant support platform(s) built into or connected with the assembly and constructed to support the weight of one or more attendant(s) and being positioned so the attendant(s) can safely stand on the platform section(s) and treat the patient while the assembly is being moved, and including safety railings to prevent the attendant(s) from falling off the assembly. Further, the assembly is designed and constructed to be stable to prevent it from tipping, leaning or becoming unstable while in use. The object of the invention is to allow a patient to be moved simultaneously while emergency medical care is administered.

34 Claims, 23 Drawing Sheets

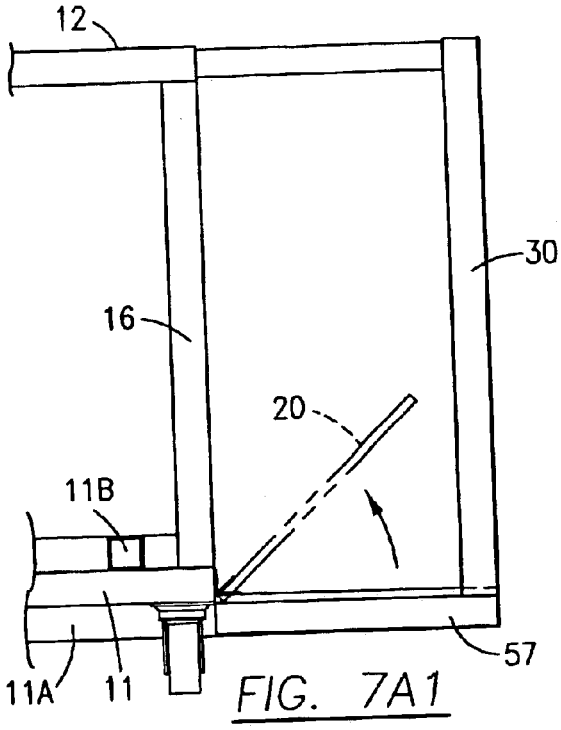
FIG. 7A1
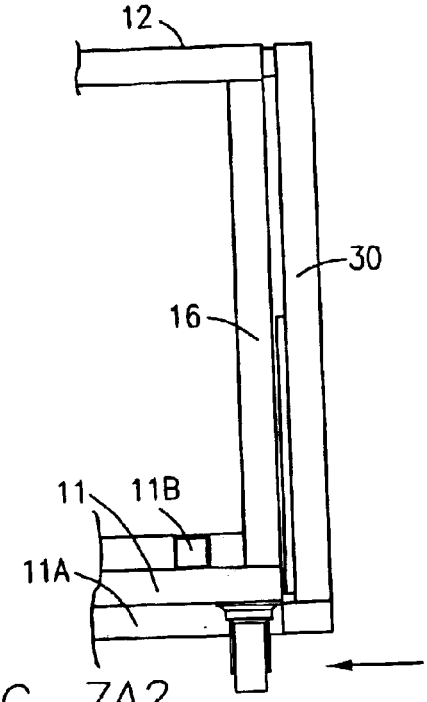
FIG. 7A2
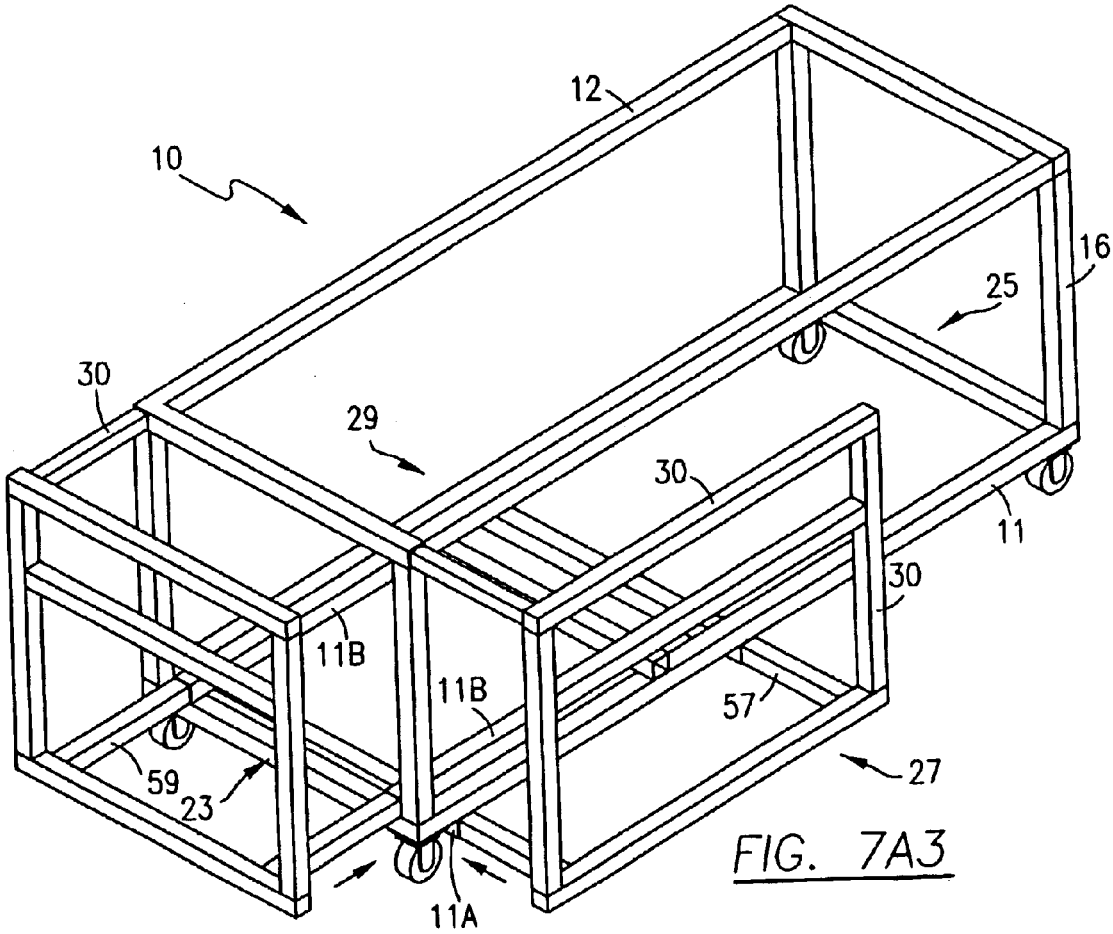
FIG. 7A3

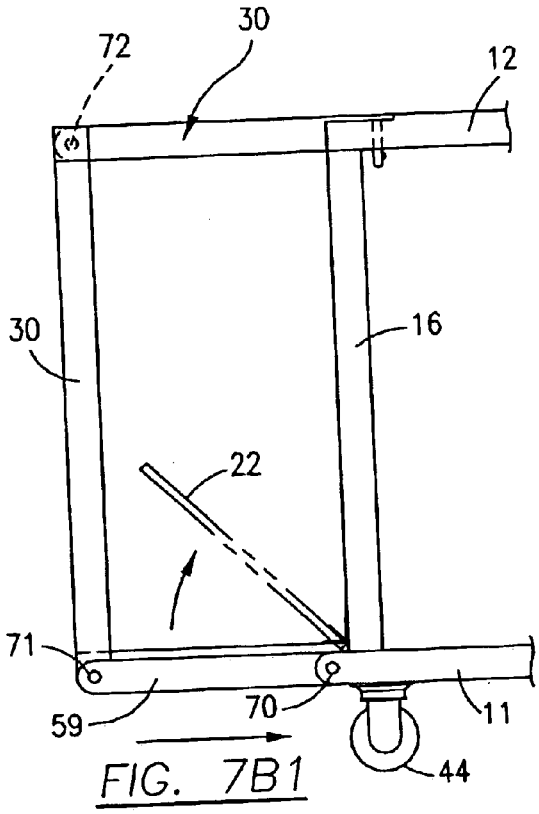
FIG. 7B1
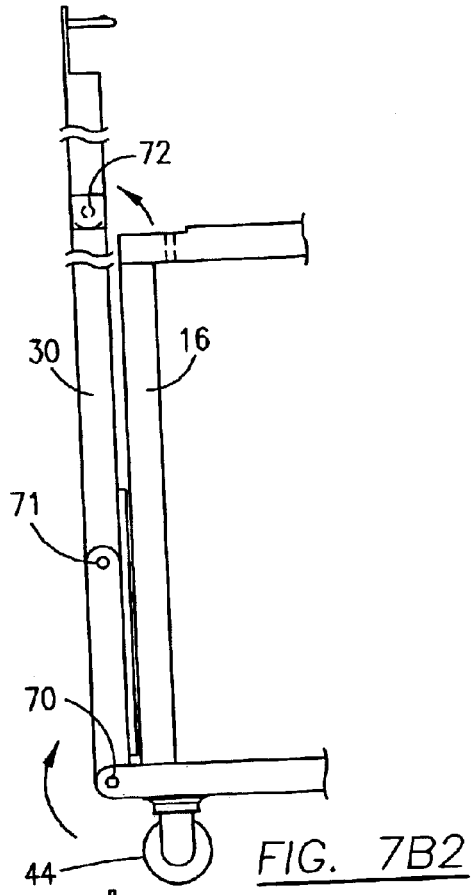
FIG. 7B2
FIG. 7B3
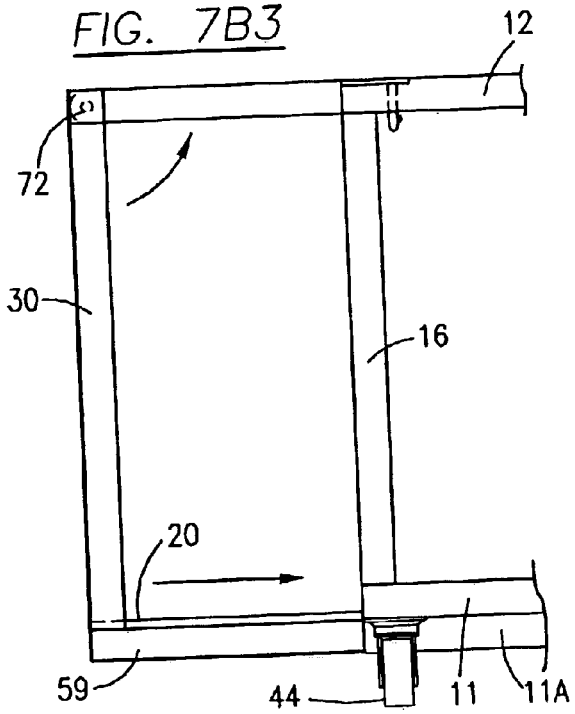
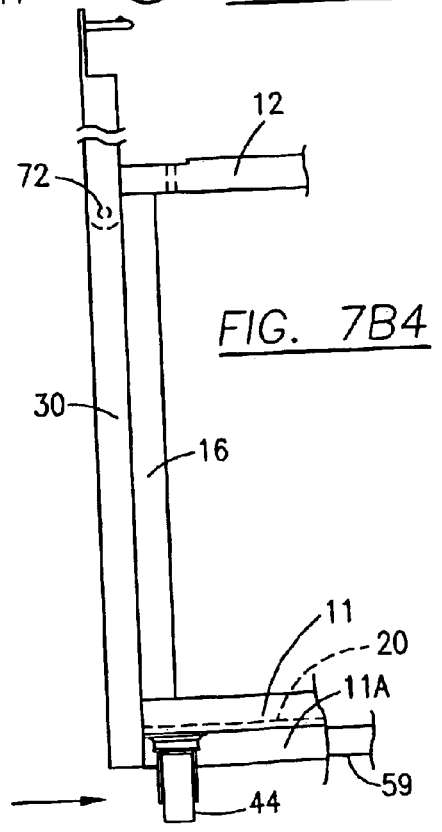
FIG. 7B4

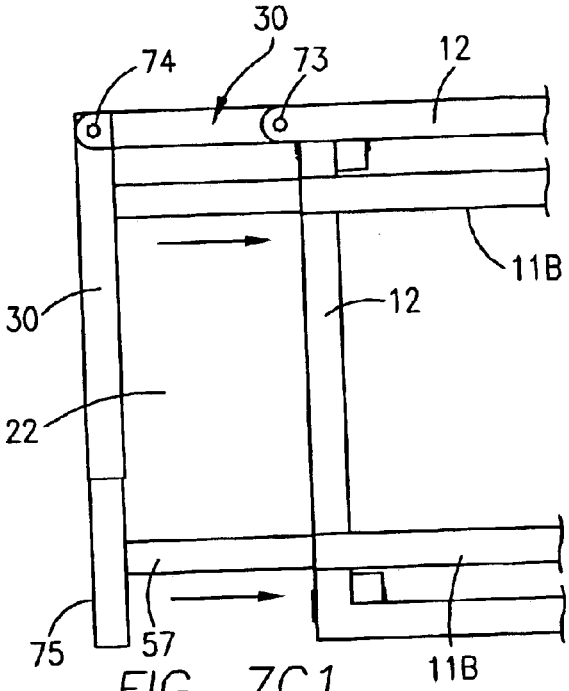
FIG. 7C1
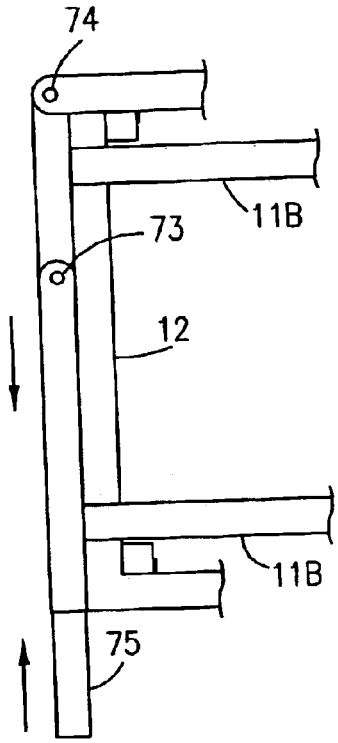
FIG. 7C2
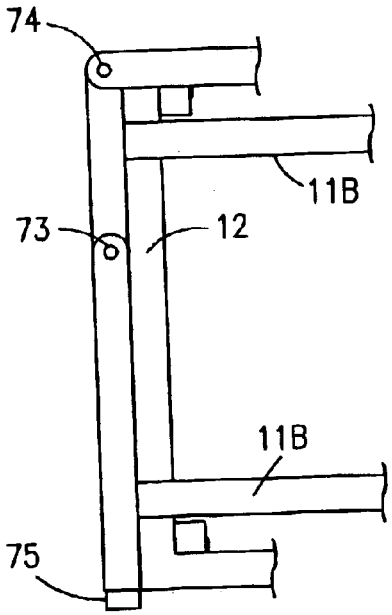
FIG. 7C3

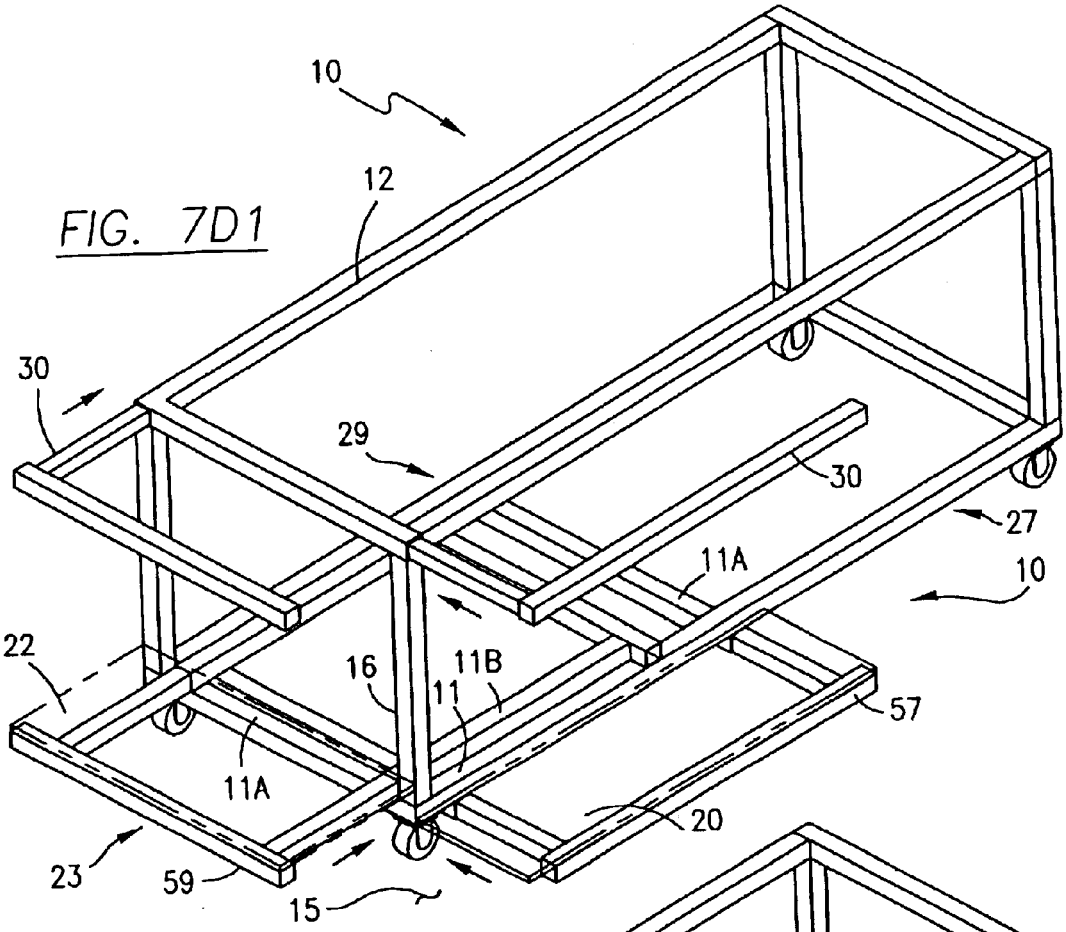
FIG. 7D1
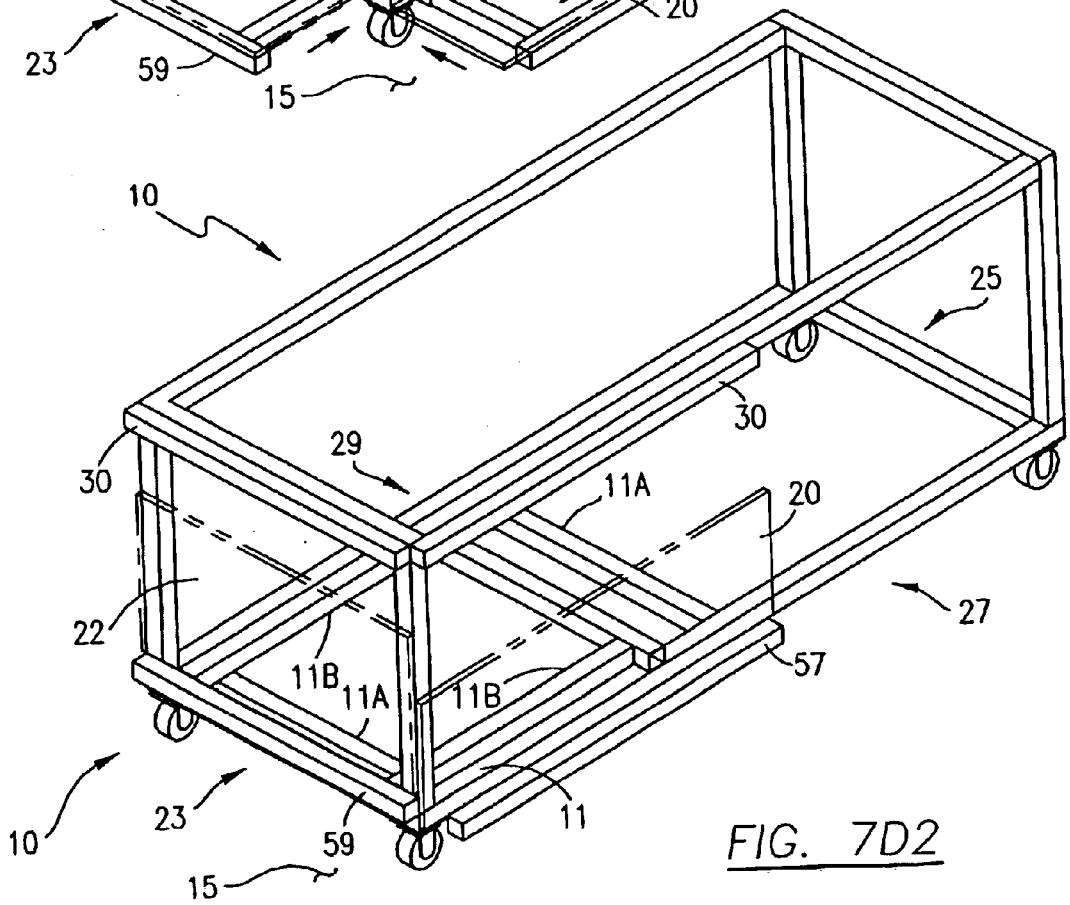
FIG. 7D2

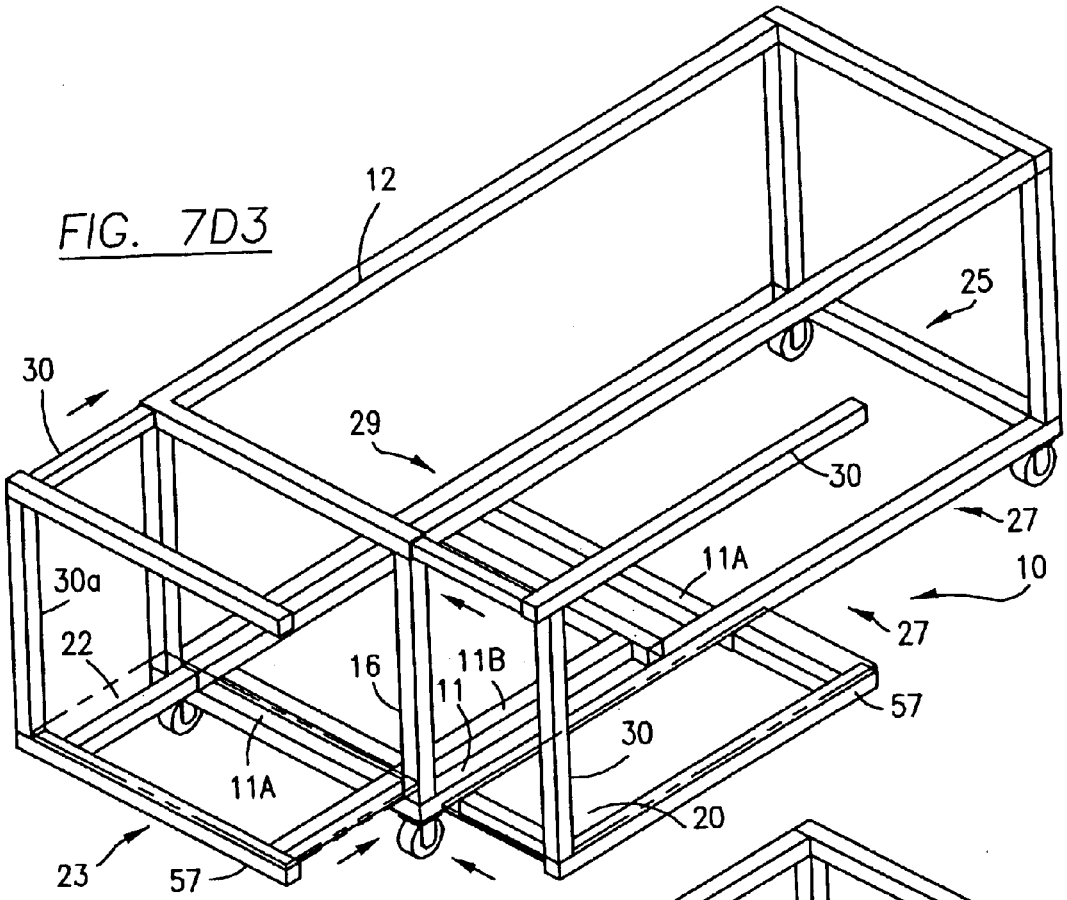
FIG. 7D3
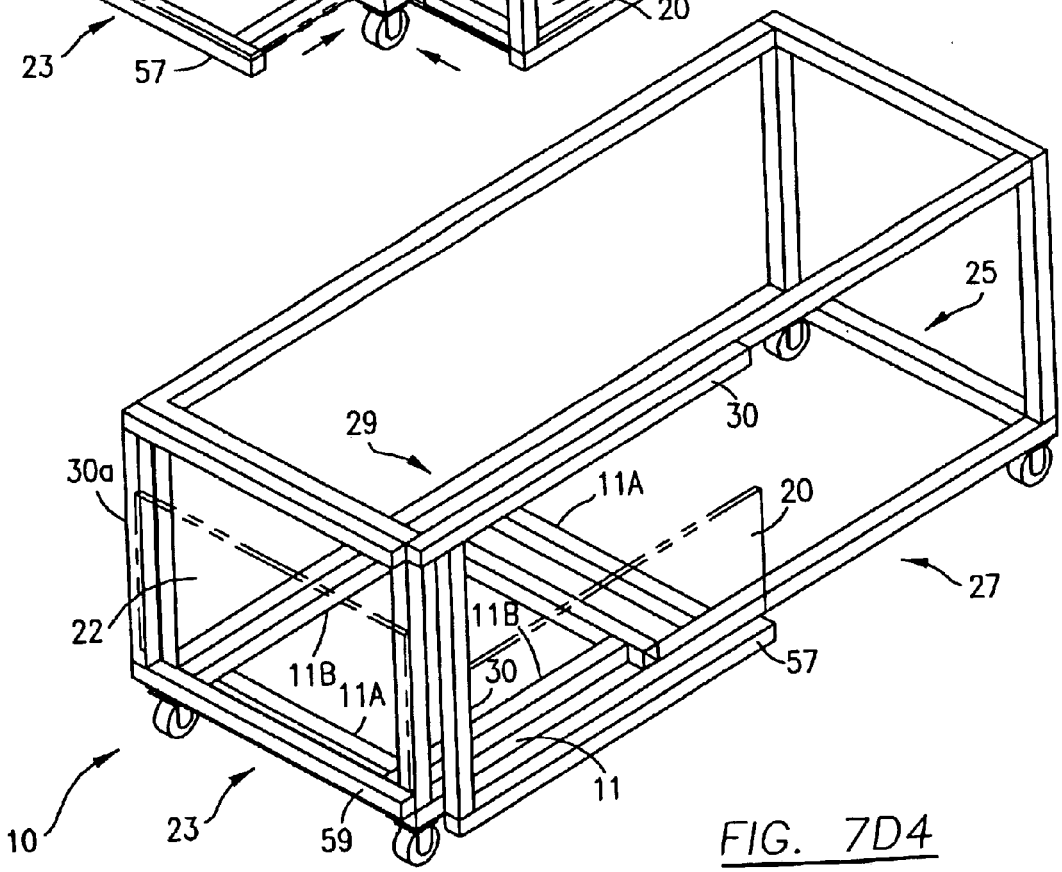
FIG. 7D4

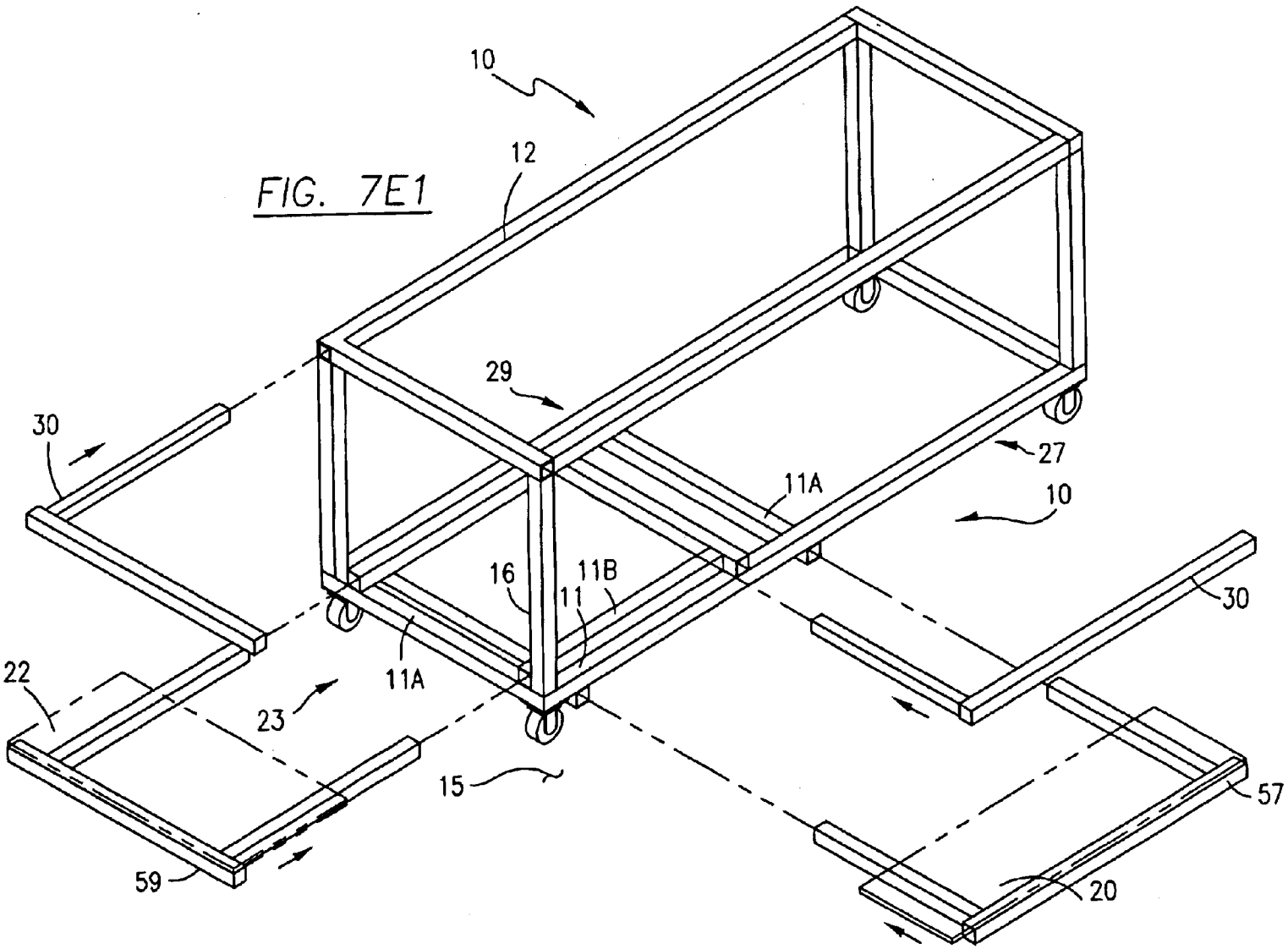
FIG. 7E1

WHEELED PATIENT STRETCHER WITH ATTENDANT PLATFORMS

BACKGROUND OF THE INVENTION

1. Field of the Invention

This invention relates generally to the field of stretchers, gurneys and other wheeled supports of patients, and specifically to mobile patient support devices capable of accommodating one or more standing attendants, administering medical care to the patient while being simultaneously transported with the patient to the appropriate treatment area.

2. Description of Related Art

Patient stretchers, gurneys and supports are well known in the art for mobile transport of a medical patient. A bedded horizontal platform may include wheels, swivel and rotatable casters, adjustable height and tilt mechanisms, foot pedals for controlling movement of the patient support surface, push handles for mobility, lifts to elevate and lower the patient support surface, and shrouds for accommodating instruments.

There is a need to safely administer emergency and often life-saving medical care while transporting a patient to another area and with the health care attendant's total devotion to the task of rendering emergency treatment rather than having to be distracted by concentrating on avoiding obstacles in transit and dangerously running alongside the stretcher during the often lengthy encumbered itinerary to the appropriate treatment area. It is usually not medically preferential to delay such care or to perform the life saving/stabilizing medical procedures before transporting the patient to the ultimate treatment destination. For example, in some instances, such as in the case of a patient in cardiac arrest, cardiopulmonary resuscitation (CPR) must be maintained continuously until a heartbeat is restored, and it is not possible to suspend CPR long enough to move the patient more than a few feet. Therefore, when performing CPR, it is not currently possible for the attendants to be mobile.

The present invention solves this problem by allowing the patient to be moved while one or two attendants stand on the mobile platform(s) and administer critical care while the patient is being moved to the appropriate area of treatment. A few minutes saved by the simultaneous rather than sequential administration of these procedures may be the difference in the preserving or losing of human life during some medical emergencies, all while enhancing the safety of the attendant.

A major problem with mobile stretchers or patient transport units on which an attendant could travel with the patient is that the attendant may fall off the stretcher during rapid transit or turning a corner when the attendant's focus is and should be solely on the patient and the rendering of medical care, as opposed to being concerned with maintaining balance and preventing his or her own fall during transit.

Although most prior art stretchers and patient transport units adequately protect the patient from falling or rolling off during transit, the few in which the attendant travels on the stretcher frame with the patient do not provide physical safeguards to the attendant and the platform does not provide adequate space for movement or stability of the attendant. The prior art also does not provide for more than one attendant being able to travel safely with the patient as there are many circumstances in which, for example, a patient needs to receive manual ventilation support in the head region, while I.V. lines and CPR are being administered on the longitudinal side of the patient. Single platform attendant support devices do not adequately solve this problem.

One such wheeled patient support having a platform is disclosed in U.S. Pat. No. 4,190,280 issued to Donohoe in which a platform is secured laterally beyond the periphery of the stretcher in the general body supporting area with a rolling surface mounted to and beneath the platform. In Donohoe, there is only one platform on the side of the patient, and none at the head, and the platform is substantially shorter in length than the length of the patient support surface, has no attached railing to safeguard the attendant from falling during transit, merely mounts to the lower frame, and requires a wheel for support. The assembly must also be stable vertically so that the additional attendant weight on the sides of the assembly do not create center of gravity shifts that could result in the assembly being unstable or tipping over.

BRIEF SUMMARY OF THE INVENTION

A mobile medical patient transport assembly having a patient bed mounted on and above a flat, horizontal, rigid, mobile support frame, with attendant support platforms that are integrated into or extend outwardly from the assembly frame for supporting one or more attendants at the side and/or head of the assembly. Safety rails are provided above the platform to aid the attendants with balance and to prevent them from falling off the platform during transit. This assembly has wheels and a stretcher or mattress so as to support and transport a patient in a supine position along with one or more standing attendants rendering medical care at the side and/or head of the patient without risk of falling off the assembly or tipping over the assembly.

The assembly comprises an upper bed supporting frame and a lower supporting frame connected by vertical supports. Attendant support platforms for supporting one or more attendants on one side or/and at one end of the bed are attached to or emanate from the lower frame. The upper frame has a rigid, planar patient mattress support deck connected to the upper frame, to receive a patient support surface such as a mattress or pad or to allow the patient to be placed directly on the support deck without a mattress or pad.

Four wheels are connected underneath the lower frame so as to be in contact with and for moving the assembly over the floor surface. The wheel(s) at the second end (foot end) of the assembly preferably swivel(s), which permits the assembly to turn corners more easily by reducing the turning radius required, and the two wheels at the first end (head end) of the assembly preferably rotate but do not swivel, allowing circumferential wheel rotation for control. All of the wheels, however, could either swivel or could rotate, depending on preference. In some variations, a single swivel wheel can be used at the second (foot) end to enhance maneuverability.

The two attendant support platforms contained within horizontal and vertical safety railings perpendicularly attached thereto, are integrated into and within the lower frame in one embodiment, or are attached to and emanate from the lower frame in an another embodiment. One attendant support platform is attached laterally on one side of the assembly along the length of the lower frame, and a second attendant support platform can be attached either along the width of the first end of the lower frame portion which is intended to be the end where the patients head lies, or can be attached laterally along the length of the lower frame opposite the other platform. Both attendant support platform sections are positioned well below the patient bed support surface, horizontally above the floor surface and substantially parallel to the floor surface, such that an attendant can stand close to the patient support surface to reach the patient thereon to render medical care while the patient, the attendants and the assembly are being wheeled to an area of treatment.

The attendant support platforms are fixed and integrated into the lower frame of the assembly in one embodiment, and in another embodiment are attached to and protrude from the lower frame assembly, and may be fixed, or retractable or removable for storage or transport through narrow doorways. If retractable, the attendant support platforms can be folded and secured upward, or telescope or slide into the frame employing various methods for doing so. When the attendant support platforms are retractable, the safety railings can also be retracted by folding or collapsing against the sides of the assembly or telescoping into the frame of the assembly. This retracting feature narrows the width and shortens the length of the assembly thereby requiring less space for storage, and permitting the assembly to fit more easily through narrow doorways.

The safety railings are attached to the attendant support platforms and may also be attached to the upper and the lower frame of the assembly, and the vertical support members, and are open at one or both ends to enable entry and exit by the attendants. When open at only one end, the safety railings may also attach to the upper frame and vertical supports. The function of the safety railings is to inhibit falls and enhance the support and balance of the attendants while administering medical care during transport of the patient.

The wheels are attached to the lower frame at the outboard limits of the frame members (corners) to enhance vertical stability to prevent leaning or tipping over with one or two attendants standing on the attendant support platform(s); however, the wheels can be placed at any location provided the assembly is stable. For instance, the attendant support platforms can have swivel wheels or casters attached to the bottom and making contact with the floor, to provide stability for the assembly while accommodating changes in direction of the assembly when it is turning corners or changing directions in confined areas. In other variations, counterweight(s) may be attached within the frame on the side and/or ends opposite the attendant support platforms positioned to counterbalance the weight of the attendant(s).

Each attendant platform section (side or end) can include an upper traction surface to minimize or prevent foot slippage of an attendant, and may be particularly useful during those times when medications and body fluids may be flowing/dripping uncontrollably or inadvertently onto the platforms uppermost surfaces under the attendant's feet.

A pad may be attached to the upper frame above each attendant support platform to provide comfortable padding for the attendants when leaning in to render treatment to the patient.

Guard rails may be included in the vicinity of the patients shoulders and arms to prevent the patients arms from falling off the patient support surface and potentially interfering with the attendant(s) standing on the attendant support platform to the side of the patient.

The primary object of the invention is to provide a wheeled patient transport assembly with a patient supine support surface and one or two platforms with physical safeguards, (i,e safety railings), to safely support and transport a patient and at least one or more medical attendants together with the patient so that the attendant(s) can deliver emergency medical care to the patient while in transit to an appropriate area of treatment while standing on a stable assembly that cannot lean or tip over with attendants standing on board, and while not having to be concerned with their own safety (i.e. falling off the assembly).

In accordance with these and other objects, which will become apparent hereinafter, the instant invention will now be described with particular reference to the accompanying drawings.

BRIEF DESCRIPTION OF THE SEVERAL VIEWS OF THE DRAWINGS

FIG. 1C-1 is a top plan view of another variation of the preferred embodiment of the present invention wherein the side attendant support platform is located on the opposite side of the assembly.

FIG. 1C-2 is a top plan view of an alternate embodiment of the present invention where both attendant support platforms are located on the sides of the assembly.

FIG. 2 shows a top plan view of the preferred embodiment shown in FIG. 1.

FIGS. 7A1 and 7A2 show a front elevational view, partially cut away, of an alternate embodiment showing an attendant support platform and railing in use in FIG. 7A1, and the attendant support platform stored against the assembly with the safety railings and attendant support platform frames telescoping into the frame assembly in FIG. 7A2.

FIG. 7A3 shows a perspective view of the alternate embodiment illustrated in FIGS. 7A1 and 7A2 demonstrating how the attendant support platform frame sections and safety railings telescoping into the frame assembly as in FIGS. 7A1 and 7A2 above, with the head end telescoping in above the structure of the lower frame and the side platform section below the structure of the lower frame assembly.

FIGS. 7B1 and 7B2 show a front elevational view, partially cut away, of another alternate embodiment of the invention showing the attendant support platform and safety railing in use, and with the side attendant platform folding up vertically and the side safety railing beams collapsing and pivoting upwardly and inwardly against the assembly.

FIGS. 7B3 and 7B4 show a front elevational view of yet another similar alternate embodiment with the attendant support platform on the head end of the assembly telescoping in above the lower frame and the safety railing beams collapsing and pivoting upwardly and inwardly against the assembly.

FIGS. 7C1, 7C2, and 7C3 show a top plan view, partially cut away, of another alternate embodiment showing the attendant support platform sections and railing in use in FIG. 7C1, and then pivotally folding inward against the support assembly frame with a telescoping top railing beam in FIGS. 7C2 and 7C3.

FIGS. 7D1 and 7D2 show yet another alternate embodiment in perspective with the attendant support platform sections and railings in use in FIG. 7D1, and with platform sections folded up against the assembly and safety railings and platform frames telescoping inwardly into the frame assembly in FIG. 7D2. In FIG. 7D2, the safety railing is open at only one end, but does not make contact with the attendant support platform.

In FIGS. 7D3 and 7D4 the safety railing has a vertical support member that connects to the attendant support platform frame in prospective view.

FIG. 7E1 shows a prospective partially exploded view of an alternate embodiment in a configuration in which the safety railings and attendant support platforms are removable for storage.

While the ideal embodiments of the present invention utilize attendant support platforms and safety railings to support the attendants and protect them from falling off the assembly, other means for supporting the attendants and keeping them on the assembly can be utilized. FIG. 12 illustrates concepts of the possibilities by showing two such other means.

DETAILED DESCRIPTION OF THE INVENTION

The Assembly in General

Figure 1:
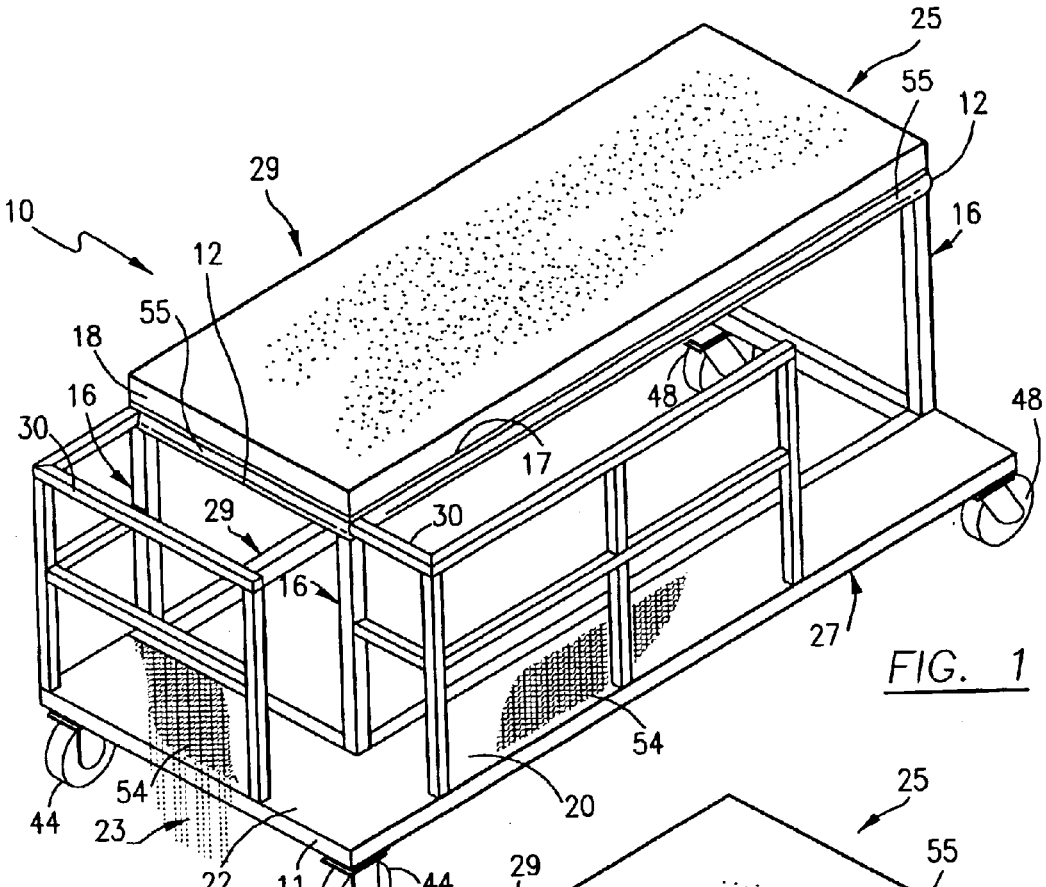
FIG. 1 shows a perspective view of the preferred embodiment of the present invention wherein the attendant platform sections (side and end) are contained within the structure of the lower frame of the patient support assembly and are connected to each other and extend for the full length and width of the assembly.
Figure 1A:
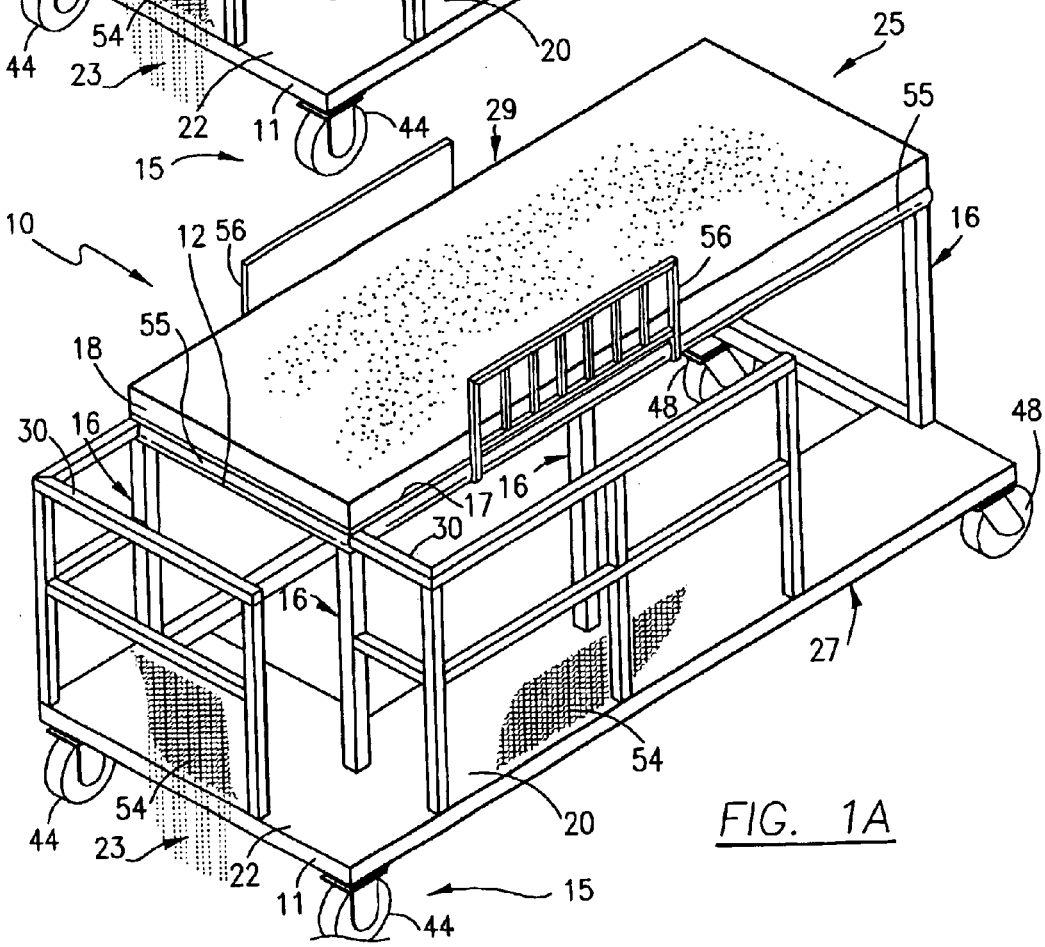
FIG. 1A shows a perspective view of a variation of the preferred embodiment of the present invention with attendant support platforms that extend underneath the upper frame and patient support surface, and shows how patient guard rails and additional vertical supports can be incorporated into the assembly.

Referring to FIG. 1, the invention is shown and comprises a wheeled patient support and transport assembly shown generally at 10 having an elongated horizontal, rigid lower frame 11, a first end 23, a second end 25, and first and second elongated sides 27 and 29 respectively. Rigid vertical supports 16 or other similar mechanisms known in the art are used for positioning and supporting the upper frame 12 above the lower frame 11. While four vertical supports 16 are preferred, more or less than four vertical supports 16 can be used, for example as shown in FIG. 1A, or the upper frame 12 can be attached to an assembly or mechanism that allows the height of the upper frame 12 and patient support deck 17 to be elevated or lowered as shown in FIG. 1G, or the upper frame can be attached to the lower frame by two strategically place vertical support members a as shown in an alternate embodiment in FIG. 4C in which the two vertical support members 16 can either be fixed, or can be vertically adjustable by electrical, hydraulic, mechanical or other means to allow the upper frame 12 and patient support deck 17 to be elevated or lowered to the desired height.

Any other means can be used to attach the upper frame 12 and patient support deck 17 to the lower frame 11 provided they are stable, securely attached and can support the weight of the patient and the stress forces exerted by the attendants while administering treatment to the patient.

The patient support and transport assembly 10 is essentially rectangular and shaped like a bed for patient support and transport. The rigid, planar patient support deck 17 can include a padded patient support surface 18 that rests on the patient support deck 17, or the patient can be placed directly on the patient support deck 17. In this preferred embodiment, the upper frame 12 and patient support deck 17 extend from the vertical supports 16, and are shorter in length and narrower in width than the lower frame 11 of the assembly by approximately the same or similar width as the attendant support platforms 20 and 22 so that the lower frame 11 extends beyond the periphery of the upper frame 12 and patient support deck 17 on the end and side where the attendant support platforms 20 and 22 are located. However, the correlation between the dimensions of the upper frame 12 and lower frame 11 can be different as shown in FIGS. 4B and 4C, such correlation being irrelevant so long as the assembly 10 is stable.

Likewise, the assembly 10 can be constructed in various configurations using various combinations of the features as described herein so long as the assembly 10 is stable and can perform its intended function.

Attendant Support Platforms

Along the first elongated side 27, of the assembly 10 there is a first rigid attendant support platform 20 at the first elongated side located in general proximity to the patients upper body and torso area, and a second attendant support platform 22 along the first end 23 in general proximity to the patients head area of the mattress surface 18. In this preferred embodiment, the two attendant support platforms 20 and 22 are preferably contained within the lower frame 11 at the first elongated side 27 and at the first end 23 and are shaped and constructed to accommodate the weight and physical dimensions of one or two adult attendants.

Figure 1B:
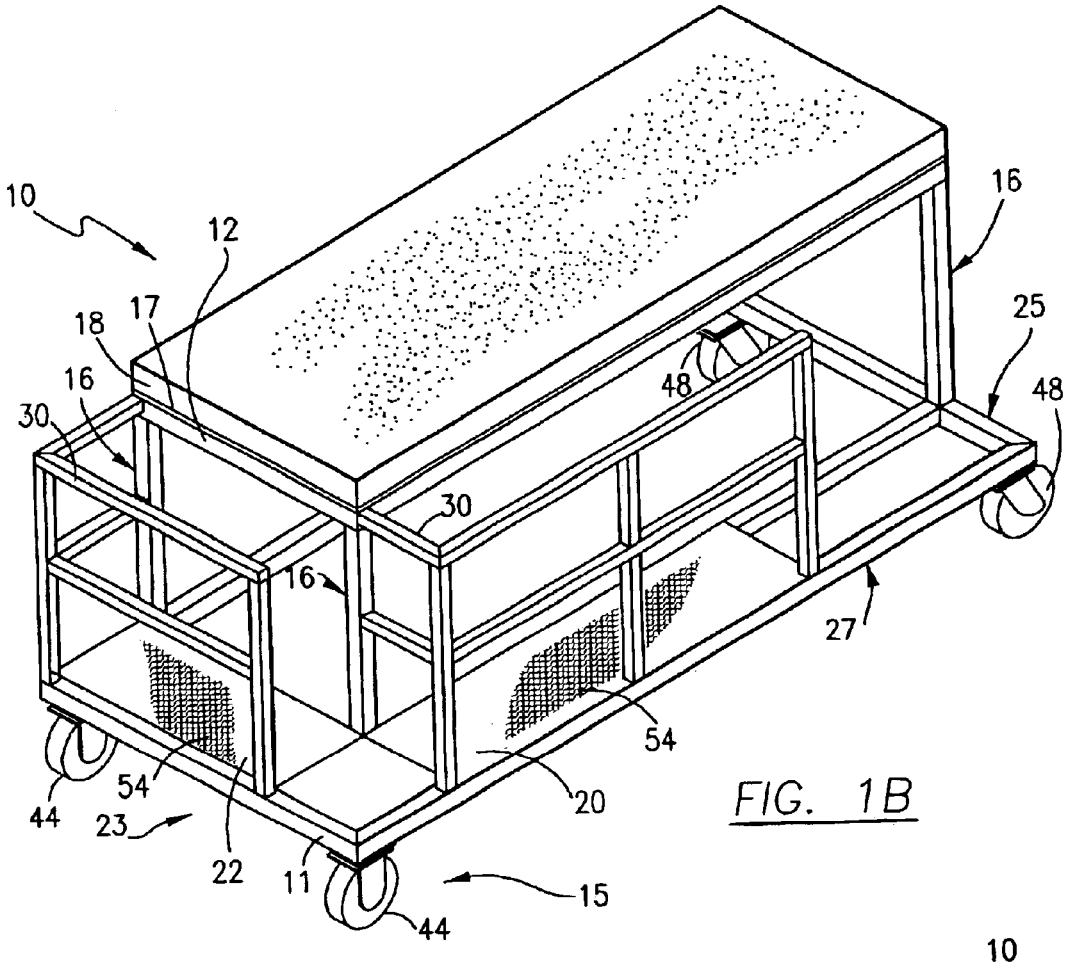
FIG. 1B shows a perspective view of a variation of the preferred embodiment of the invention, wherein the head and side attendant platforms are separated and do not extend for the full length and width of the assembly.

Each attendant support platform 20 and 22 can occupy the entire length and width of the first elongated side 27 and first end 23 respectively as shown in FIGS. 1 and 1A, or occupy only a portion of the length and width of the first elongated side 27 and first end 23 similar to that shown in FIG. 1B. The attendant support platforms 20 and 22 can be connected to each other as shown in FIGS. 1 and 1A, or detached from each other as shown in FIG. 1B.

The attendant support platform sections 20 and 22 can end at the outside perimeter of the upper frame 12 as in FIGS. 1 and 1B, or can extend underneath the outside perimeter of the upper frame 12 similar to that shown in FIG. 1A thereby providing extra toe/foot room for the attendants.

Figures 1, 1C:
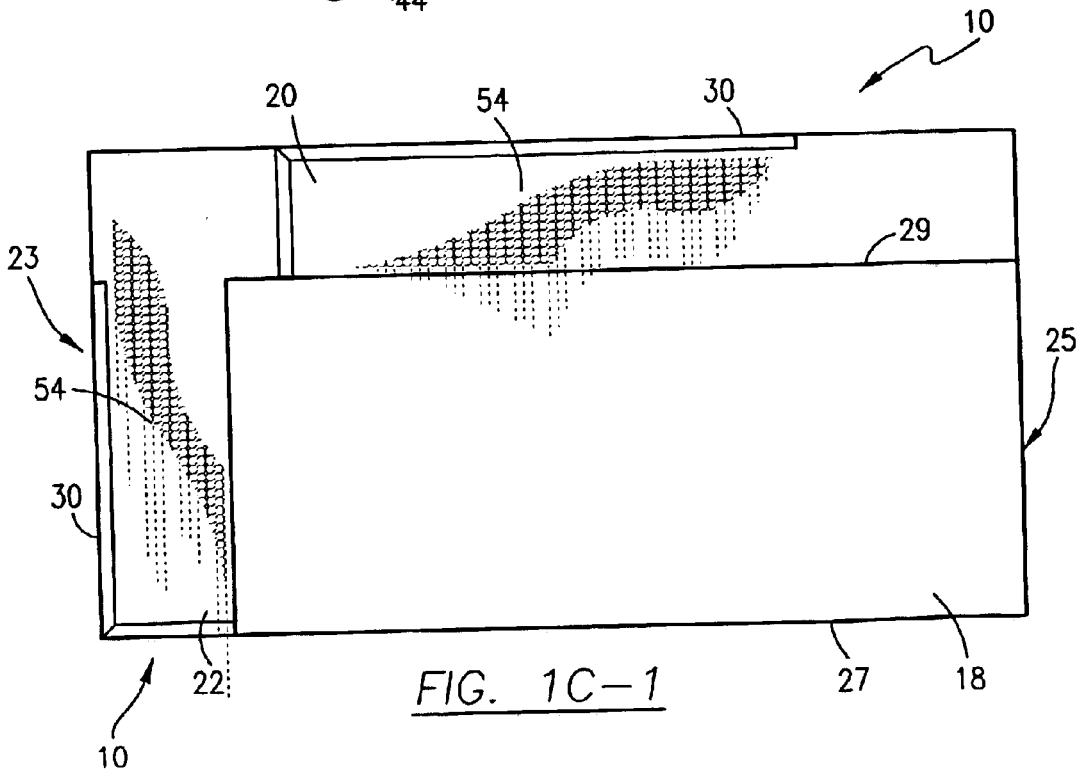

The attendant support platform 20 can be placed on the second elongated side 29 as shown from a top view in FIG. 1C-1, in which case the upper frame 12, patient support deck 17 and vertical supports 16 are placed such that edges of the first elongated side 27 of the upper frame 12 and patient support deck 17 are in line and even with, or contained within the edges of the lower frame 11 on the first elongated side 27 underneath the patient support deck 17. The attendant support platforms 20 and 22 may also be placed opposite each other and occupy part or all of both elongated sides 27 and 29 as shown from a top view in FIG. 1C-2.

The upper surface of the attendant support platforms 20 and 22 can be exposed, or a tread or friction-inducing surface 54 can be added to provide traction for and prevent slippage of the attendant(s).

A pad 55 as shown in FIGS. 1 and 1A can be attached to the upper frame 12 above each attendant support platform 20 and 22 to provide comfortable padding for the attendant(s) when leaning in to render treatment to the patient, or there can be no padding as shown in FIG. 1B.

Figures 1, 1C, 2:
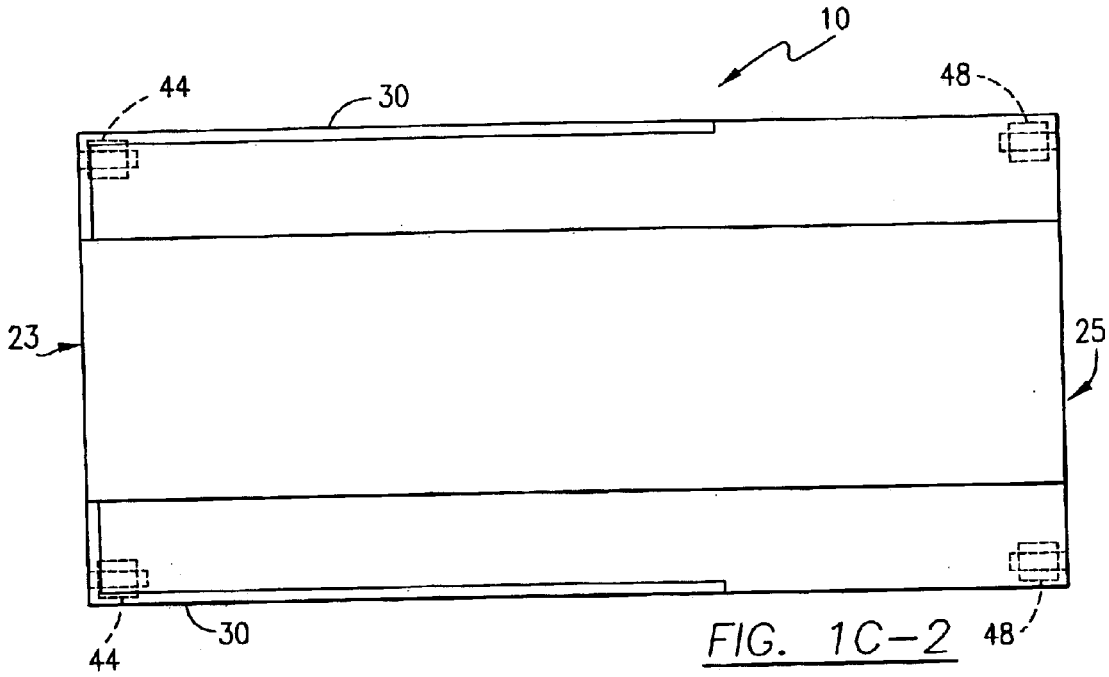
Figure 1D:
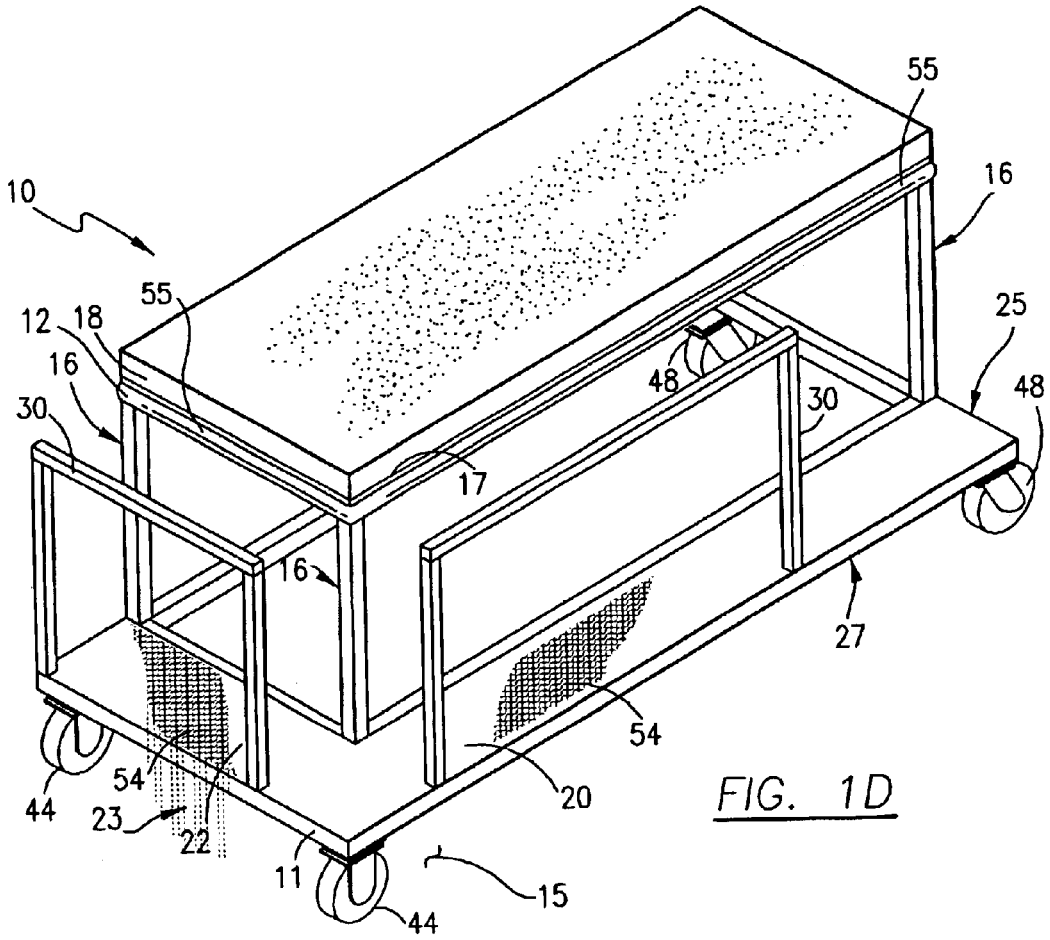
FIG. 1D is a perspective view of yet another variation of the preferred embodiment of the present invention with a simple safety railing construction wherein the safety railings do not connect to the upper frame or vertical support members.
Figure 1E:
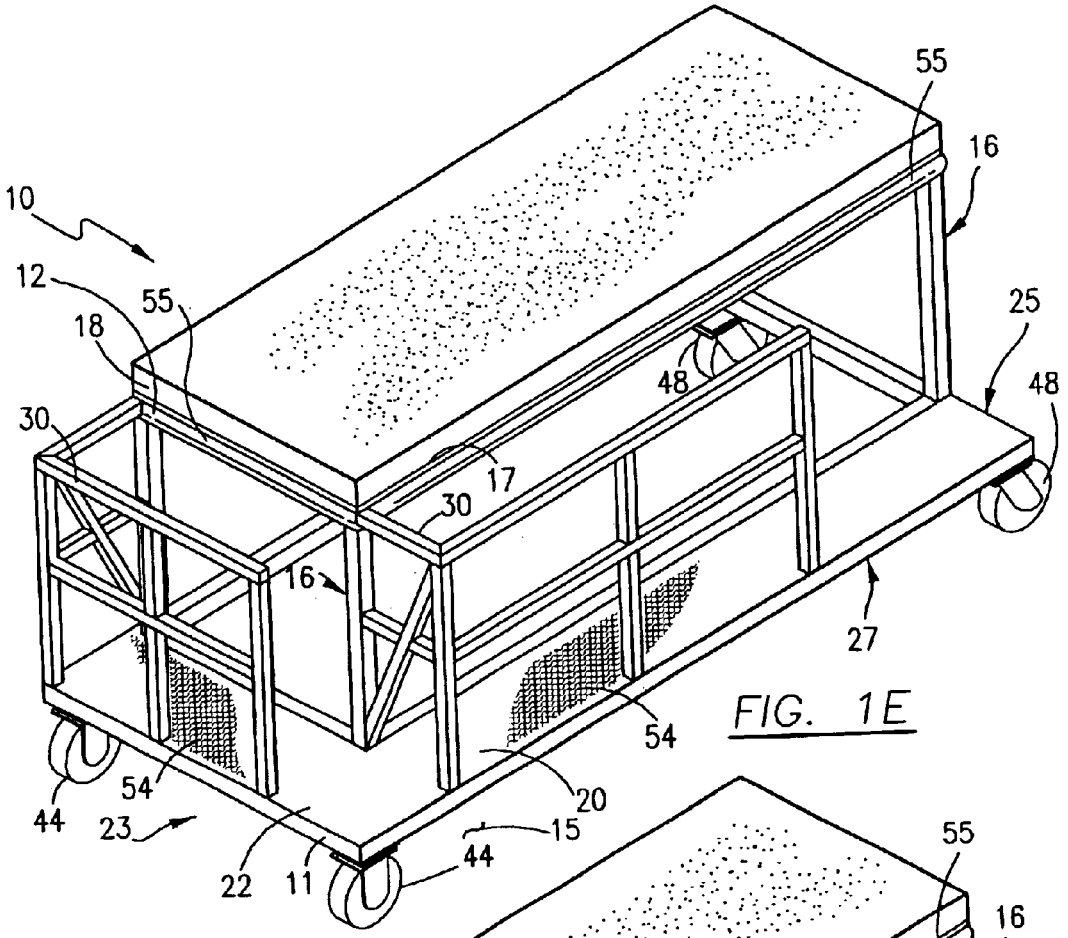
FIG. 1E is a perspective view of another variation of the preferred embodiment of the present invention that shows a more complex safety railing construction wherein the safety railings are connected to the upper frame and vertical support members.
Figure 1F:
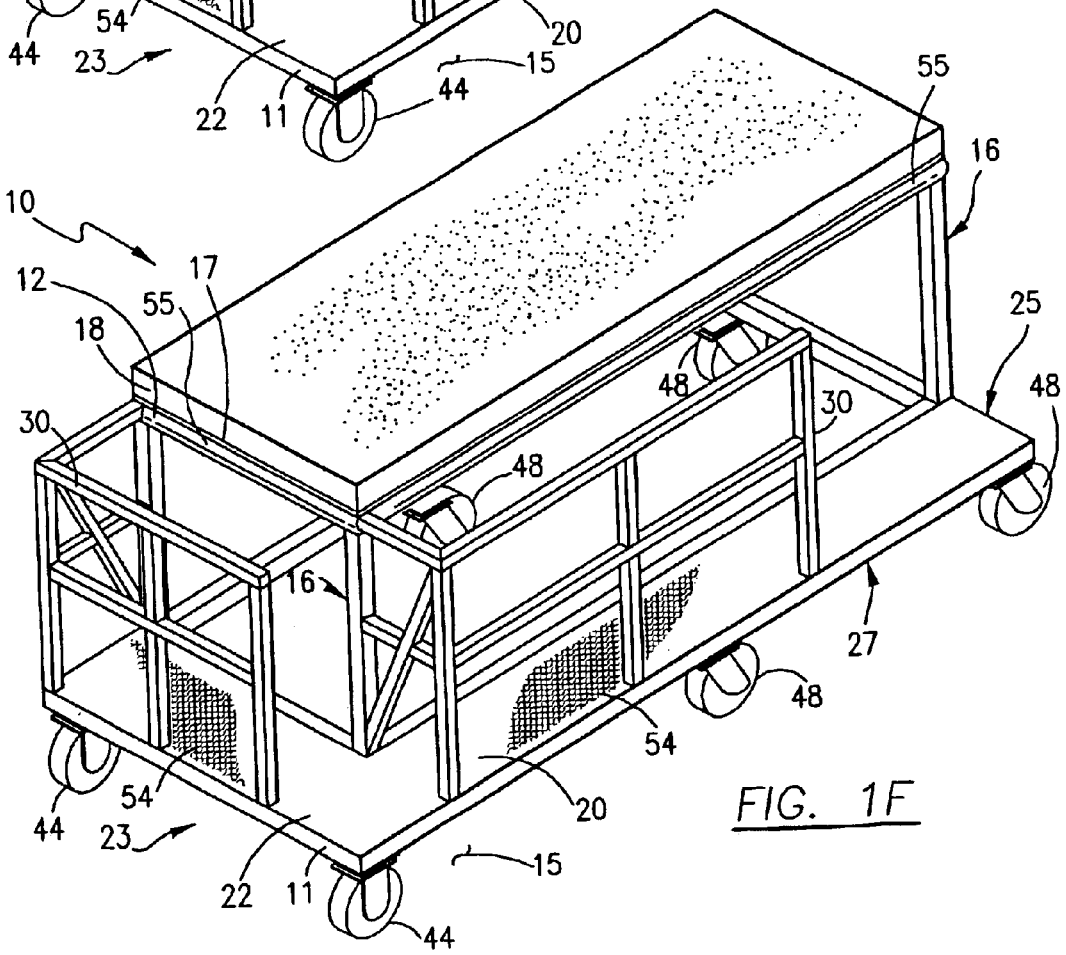
FIG. 1F is a perspective view of another variation of the preferred embodiment of the present invention that incorporates more than four wheels.
Figure 1G:
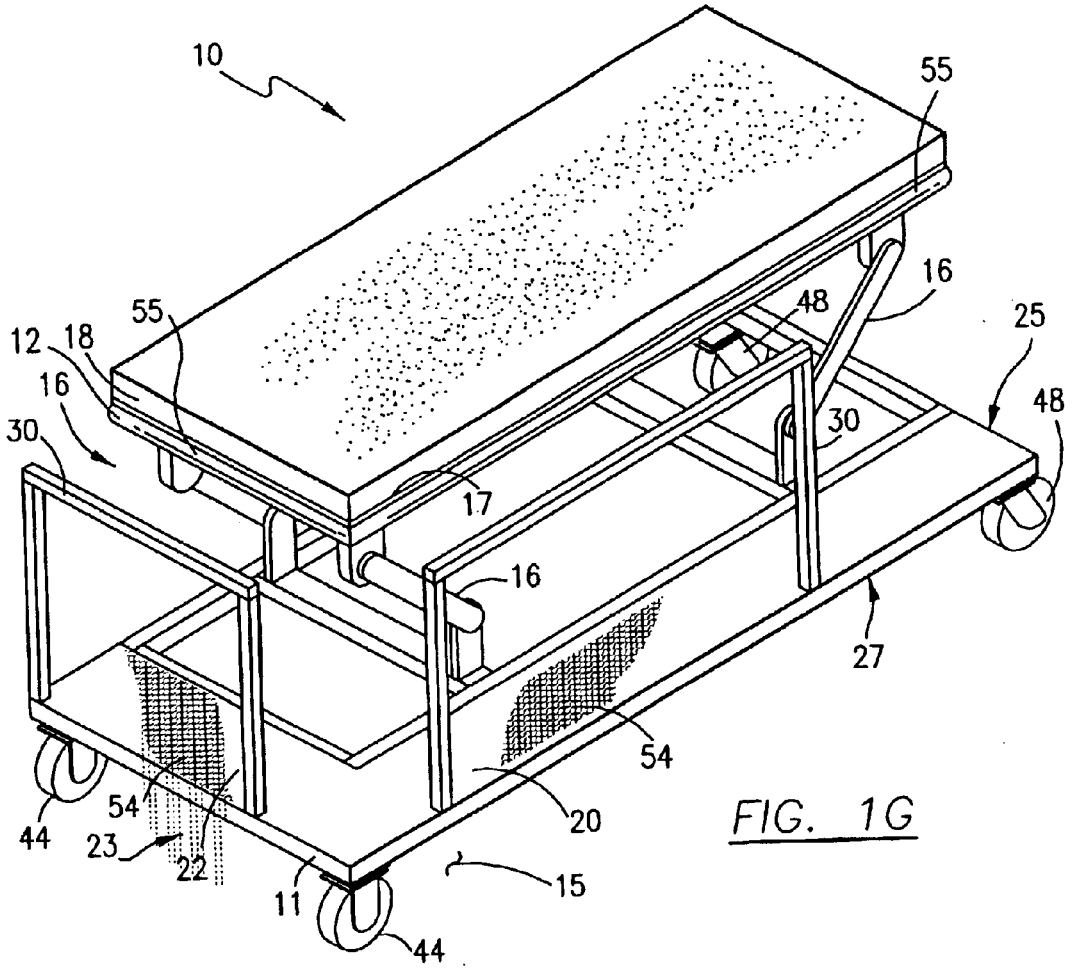
FIG. 1G is a perspective view of another variation of the preferred embodiment of the present invention wherein a mechanism for raising and lowering the upper frame and patient support surface replaces the vertical support members, and the safety railings are connected only to the attendant support platforms and lower frame.
Figure 1H:
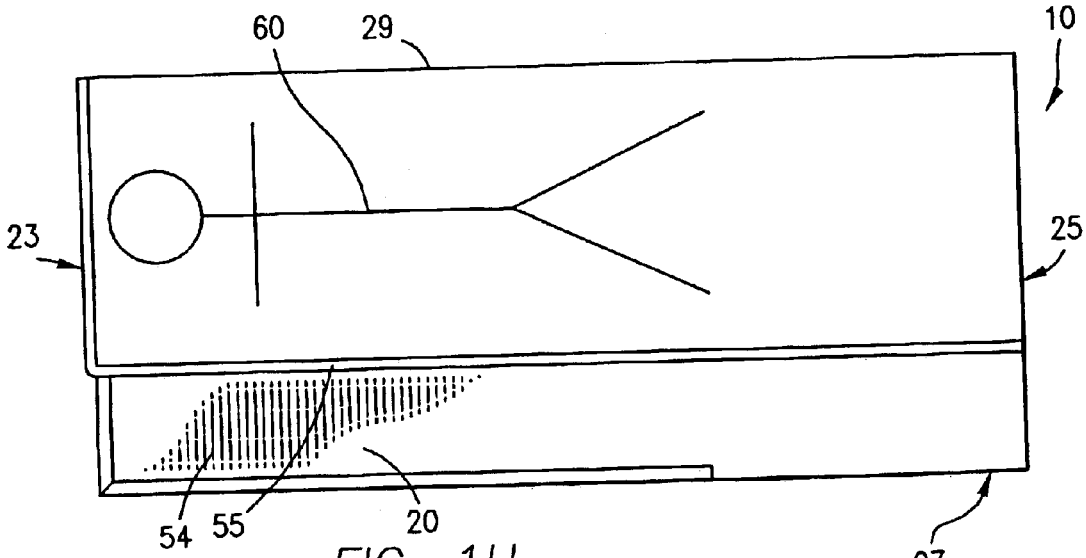
FIG. 1H is a top plan view of an alternate embodiment of the present invention with only one attendant support platform and safety railing located at one side of the assembly.
Figure 2:
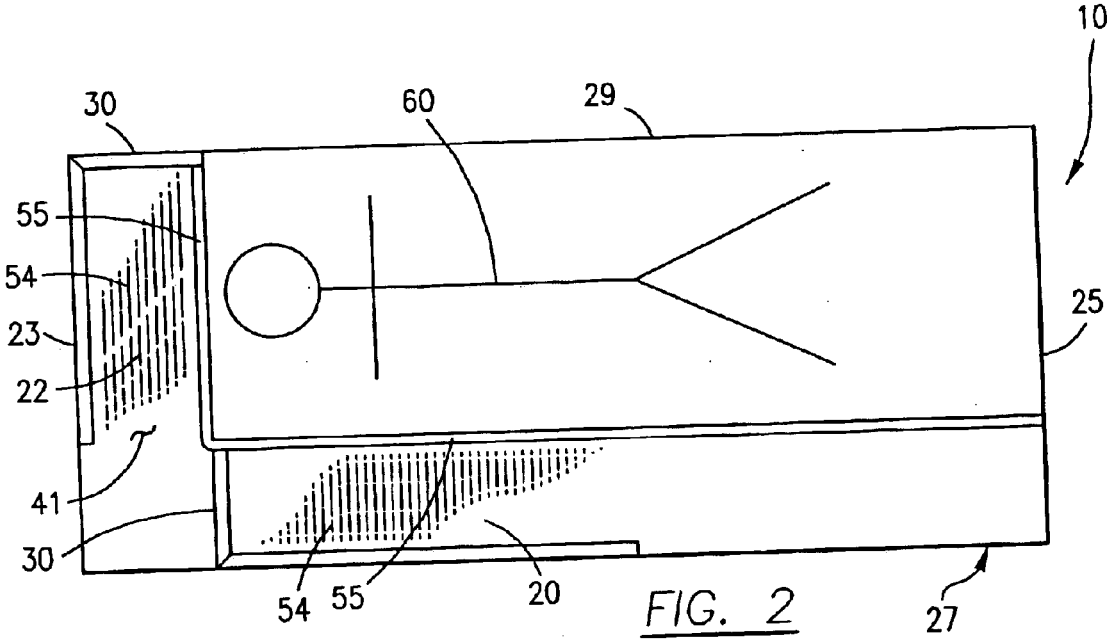

In some instances, it may be desirable to have a mechanism for adjusting the height of the upper frame 12 and patient support deck 17 as shown in FIG. 1H.

In other instances where space is limited, it may be desirable to have only one attendant support platform 20 as shown in FIG. 1I. In this embodiment, the attendant support platform 20 is sufficiently wide and long to accommodate two adult attendants, and is placed along the first or second elongated side 27 or 29 in a position that allows one attendant access to a patients head area and the other attendant access to the patients upper torso area so both attendants can simultaneously administer treatment to the patient.

Safety Railings

Each attendant support platform 20 and 22 includes safety railings 30 attached at one or more areas to the lower and upper frames 11 and 12 and to the vertical supports 16 and the attendant support platforms 20 and 22 along the outermost longitudinal edge of the attendant support platforms 20 and 22. The safety railings 30 are affixed in such a manner, welded, bolted, screwed, as to withstand the weight of the attendants leaning, falling, or otherwise safely supported by the safety railings 30. The safety railings 30 can extend for the partial length of the attendant support platforms 20 and 22 as shown in FIGS. 1, and 1A, or can extend for the entire length of the attendant support platforms 20 and 22 as shown in FIG. 1B. To allow for ingress and egress of the attendants, the safety railings 30 can be open at only one end as shown in FIGS. 1, 1A, and 1B, or can be open at both ends as shown in FIG. 1D. The safety railings 30 can be comprised of relatively simple configuration similar to that shown in FIG. 1D, or more complex configurations similar to that shown in FIGS. 1, 1A, 1B, and 1E.

The safety railings 30 function to protect the attendant(s) from falling and provide an area of balance for the attendant during transport and/or while administering treatment. The safety railings 30 are particularly important during conditions of emergency where rapid transport is desirable and the attendants must devote full concentration and attention to the patient without being unduly distracted by concerns for their own safety.

While safety railings 30 are the preferred means for preventing the attendants from falling off the attendant support platforms, belts, restraints, brackets, supports, braces or other means can be employed for this purpose.

Guard Rails

In both the preferred and alternate embodiments and variations thereof, two guard rails 56 can be attached to the upper frame 12 of the assembly 10 along the two elongated sides 27 and 29 in the vicinity of the patient's shoulders and arms as shown in FIG. 1A. The purpose of these guard rails 56 is to prevent the patient's arms from extending beyond the periphery of the upper frame 12 so that the patient's arms cannot interfere with the attendants. The guard rails 56 protrude above the patient support deck 17 and patient support surface 18 sufficiently to contain the patient's arms within the confines of the upper frame 12, but not extend so far as to interfere with the attendant. The guard rails 56 can be particularly useful when the assembly is constructed in a narrow fashion for use in environments where space is limited or doorways are narrow. The guard rails 56 when included in the assembly 10 can either be fixed or detachable, or can be attached to the upper frame 12 so the guard rails collapse or fold out of the way. The guard rails 56 can be composed of a series of rails as shown on the first elongated side 27 in FIG. 1A, or a solid piece of material as shown on the second elongated side 29 in FIG. 1A. If necessary when there is padding 55 attached to the upper frame 12, then this padding 55 is molded or contoured around the area where the guard rails 56 attach to the upper frame 12.

Wheels

Figure 10A:
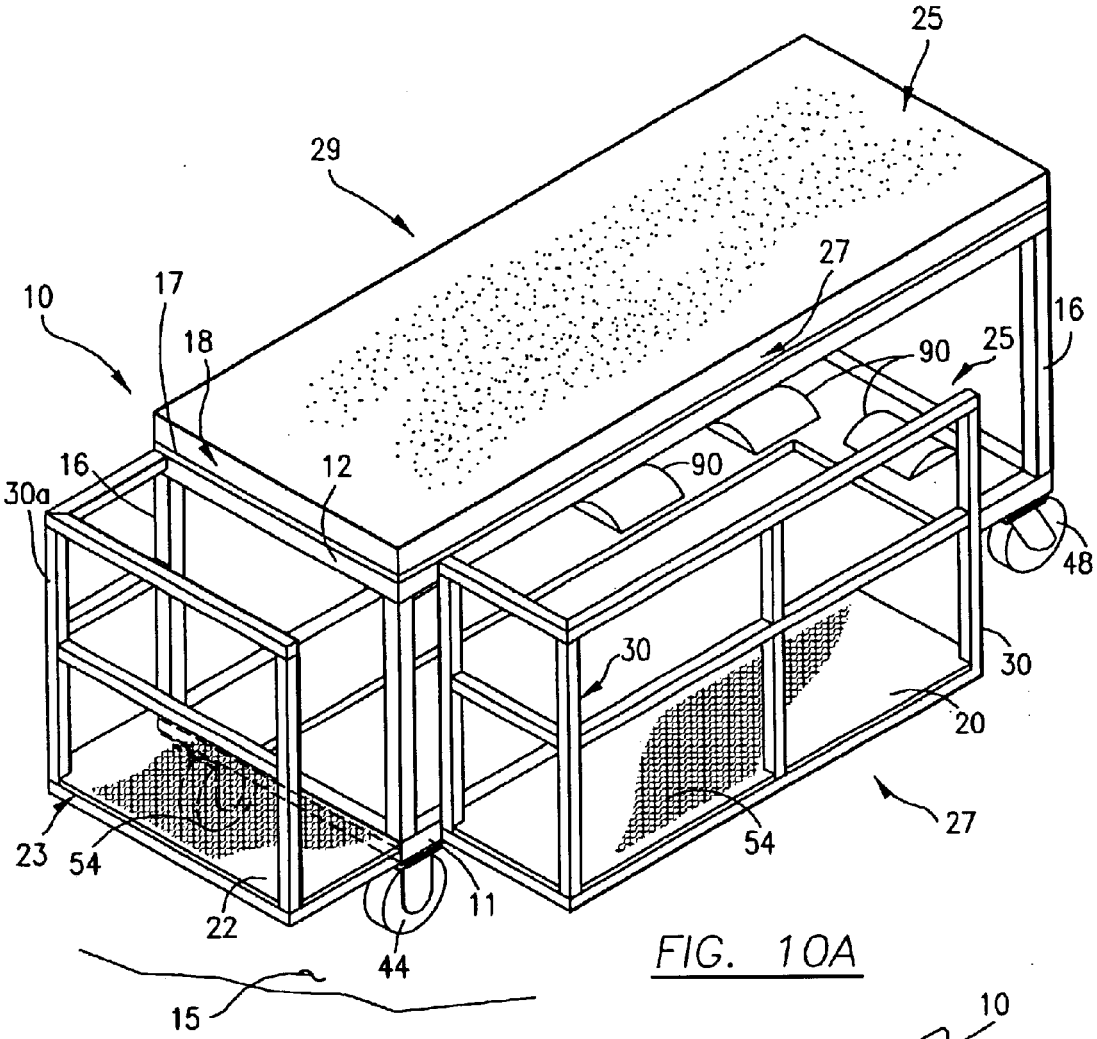
FIG. 10A shows a perspective view and FIG. 10B shows a bottom plan view of an alternate embodiment with counterweights on the side and end opposite the attendant platforms which are positioned strategically to offset the weight of the attendants and prevent the assembly from tipping or becoming unstable while the attendants are standing on the attendant support platforms and 22.
Figure 10B:
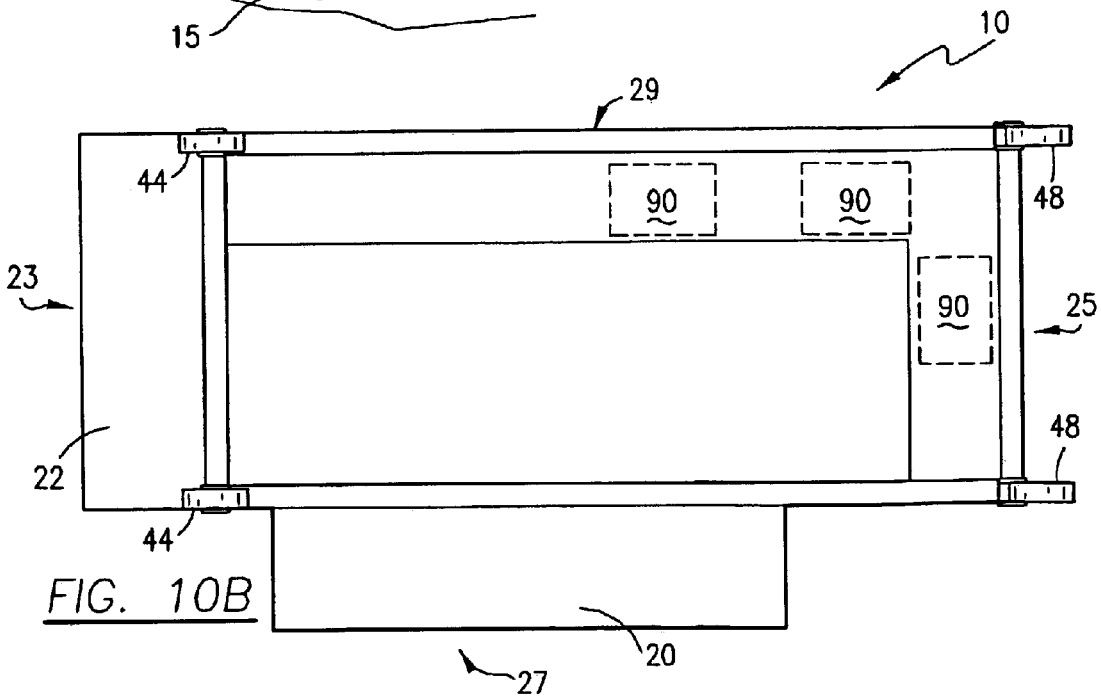

The wheels 44 and 48, two of which 44 are at the first end 23 of the assembly 10, and two of which 48 are at the second end 25 of the assembly 10, are mounted beneath the lower frame 11 either underneath the four corners, underneath the vertical supports 16 or in close proximity to the four corners of the lower frame 11 as shown in FIGS. 1, 1A, 1B, 1C-1, 1C-2, 1D, 1E, 1F and 1I; or within the confines of the lower frame 11 away from the outer edges of the lower frame 11 as shown in FIGS. 1G and 1H, which gives more foot clearance to the attendants pushing and/or standing around the assembly, or accommodates a mechanism for elevating or lowering the upper frame 12 and patient support surface 17 as shown in FIG. 1H. Regardless of the configuration or the number of wheels 44 and 48, the wheels 44 and 48 extend downward to contact the floor surface 15. The wheel(s) 48 at the second end 25 of the assembly 10 preferably swivel so as to permit the assembly 10 to turn corners more easily by reducing the turning radius required. The wheels 44 at the first end 23 of the assembly 10 preferably are such as to allow only circumferential wheel rotation for control, however, any sturdy, easy to roll wheel can be used at either end 23 and 25. The wheel location is important to ensure vertical stability of the assembly during transit. Strategically place weights 90 can also be employed for stability as shown in FIGS. 10A and 10B.

While four wheels 44 and 48 placed in the four corners of the assembly 10 are the preferred means for moving the assembly 10 across the floor surface 15, any number of wheels or any other means such as castors, bearings, pads or skids composed of metal or a low friction material such as Teflon, nylon or similar materials, air pressure or other means that allow the assembly to be easily moved across the floor surface 15 can be employed, and they can be placed at any position on the lower frame provided that the assembly 10 is vertically stable and does not tip, lean or fall over.

Construction

The assembly 10 lower frame 11 and upper frame 12, structural and vertical support frame members 16, attendant support platforms 20 and 22, safety railings 20 and guard rails 56 are preferably constructed of tubular steel, aluminum, or any durable material customarily used for stretchers, gurneys, carts, and hospital beds; however, the frame vertical support members can be constructed of any durable, sturdy material capable of supporting the weight of a patient and the attendants while still being relatively easily movable for transport of all persons to another location by a person or persons pushing or pulling the assembly along the floor surface 15. When constructed of metal, the assembly 10, lower frame 11 and upper frame 12, structural and support frame members 16 can be connected by welding the respective connecting ends together in the conventional way, however, screws, bolts, or other conventional fasteners can be utilized, particularly when the frame supports, beams, platforms, and sides are constructed of wood or PVC. Regardless of the construction materials selected, the assembly 10 must be strong and durable enough to withstand the weights of the patient and attendants and the stress forces imparted on the assembly 10 during transport, including impact with walls and other devices encountered during emergency transport of the patient and attendants.

PURPOSE AND FUNCTION OF THE INVENTION

The purpose of the instant invention is to enable emergency transport of patients in critical medical crises to an appropriate area of treatment like an operating room while one or more medical attendants simultaneously administer medical treatment during transport without the assembly leaning, tipping over or otherwise becoming unstable. Accordingly, the duration of each use is likely to be brief. The patient will be placed on the assembly 10, moved to the appropriate area of treatment and removed from the assembly 10 upon arrival. Therefore, the design and structure of the assembly 10 need only be very basic; however, additional features as discussed throughout can be included to enhance the invention.

FIG. 1 shows a prospective view of the invention in its preferred embodiment. In the preferred embodiment, the attendant platform platforms side 20 and end 22 are contained within the structure of the lower frame 11 of the assembly 10, and are connected to each other and extend for the full length and width of the assembly 10.

FIG. 2 shows a top plan view of the preferred embodiment as shown in FIG. 1.

Figure 3:
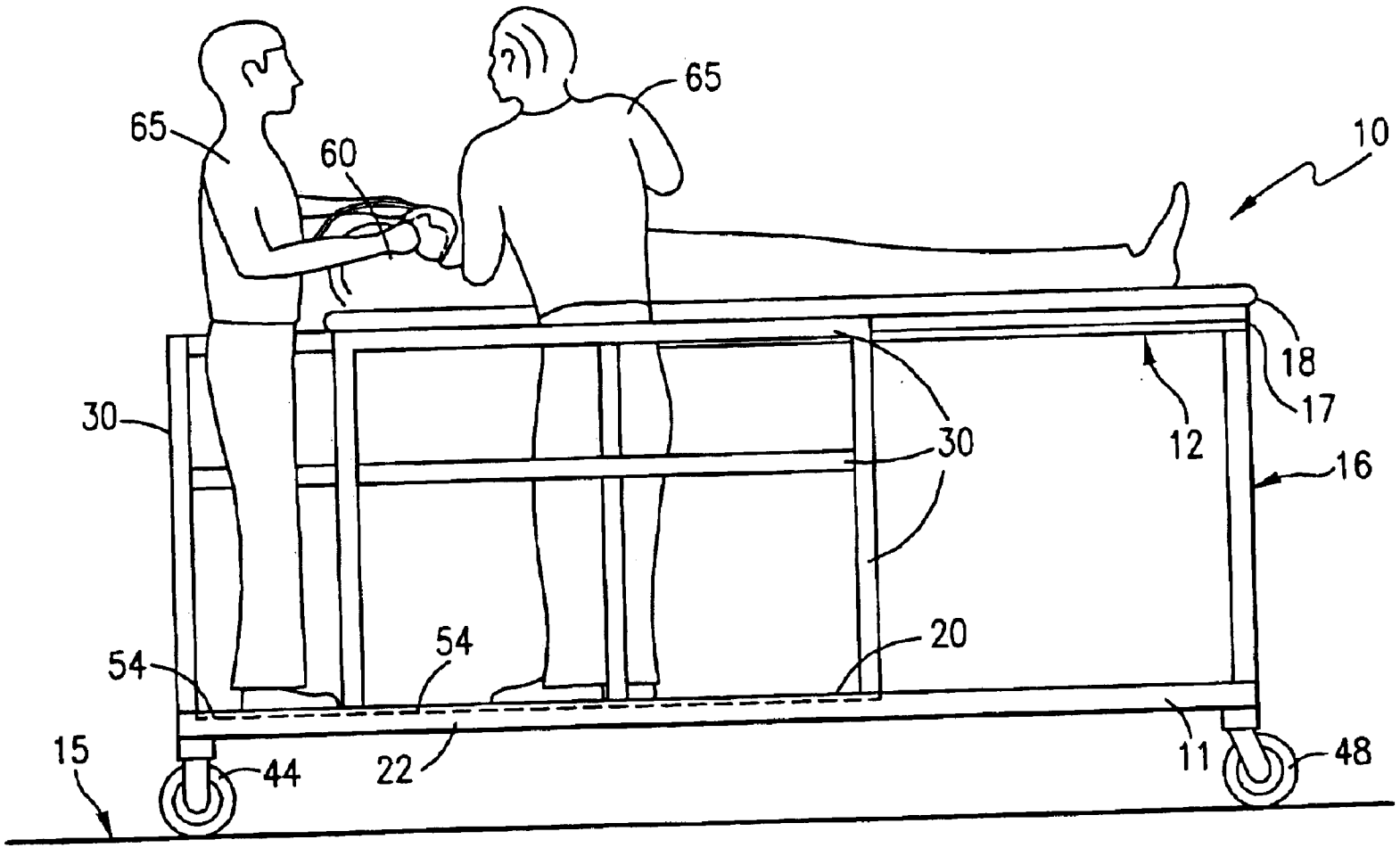
FIG. 3 shows a side elevational view of the preferred embodiment shown in FIG. 1 in use while the assembly, the patient, and attendants rendering medical treatment to the patient are being wheeled to an area of treatment.

FIG. 3 shows a side view of the assembly 10 in its preferred embodiment while in use. The assembly 10 is in use with the patient 60 laying on the patient support deck 17 or patient support surface 18 with two attendants 65 administering treatment while the assembly 10, patient 60 and attendants 65 are being wheeled to an area of treatment. The two attendants 65 are standing on the attendant support platforms 20 and 22 with adequate working and moving space available on the respective attendant support platforms 20 and 22. The attendant support platform 20 on the first elongated side 27 can be of sufficient length to accommodate a second attendant (not shown) on the same attendant support platform 20.

FIGS. 1A, 1B, 1C-1, 1C-2, 1D, 1E, 1F, 1G, and 1H show variations of the preferred and alternate embodiments of the present invention. In FIG. 1A, there are more than four vertical supports 16; and the attendant support platforms 20 and 22 protrude beneath the periphery of the upper frame 12 to provide additional toe and foot room for the attendants. FIG. 1A also includes guard rails 56 to retain the patients arms which may be fixed, detachable or foldable. FIG. 1B shows a configuration of the preferred embodiment in which the attendant support platforms 10 and 22 do not touch, and do not occupy the entire length and width of the lower frame 11. FIG. 1C-1 shows a top view of the preferred embodiment wherein one of the attendant support platforms 20 is on the second elongated side 29 instead of the first elongated side. FIG. 1C-2 shows a top view of the preferred embodiment wherein the two attendant support platforms 20 and 22 are opposite each other and attached to the two elongated sides 27 and 29. FIG. 1D shows a relatively simple structure for the safety railings 30 having two open ends, and FIG. 1E shows a more complex structure of safety railings 30. FIG. 1F shows a configuration of the preferred embodiment with more than four wheels 44 and 48. FIG. 1G shows a configuration with the upper frame 12 and patient support deck 17 mounted on a mechanism that allows the height of the upper frame 12 and patient support surface 17 to be elevated and lowered either manually, mechanically, hydraulically, electrically or by other means employable for raising and lowering a surface. FIG. 1H shows a configuration with only one attendant support platform 20 which is sufficiently wide and long to accommodate two attendants in a position where they can render treatment to a patients head and chest area simultaneously.

The main differences between the preferred embodiment and alternate embodiments shown in FIGS. 4, 4A, 4B, and 4C are that in the preferred embodiment the attendant support platforms are contained within or integrated into the lower frame of the assembly, whereas in the alternate embodiments the attendant support platforms are attached to and protrude from the lower frame of the assembly. The alternate embodiment also makes it possible to retrofit existing patient transport mechanisms with attendant support platforms 20 and 22. As with the preferred embodiment, there are similar variations of these alternate embodiments. Some of these variations as shown in FIGS. 7, 8, 9, 10, 11 and 12 series can be constructed with attendant support platforms 20 and 22 and safety railings 30 that can fold, collapse and/or telescope, wheeled supports underneath the attendant support platforms 20 and 22, counterweights 90 to offset the weight of the attendants standing on the attendant support platforms 20 and 22, and as with the preferred embodiment there may be included mechanisms for elevating and lowering the upper frame 12 and patient support surface 17. Otherwise, the alternate embodiments and their variations are similar in form and function to the preferred embodiment, and can have the same or similar configurations and features.

Figure 4:
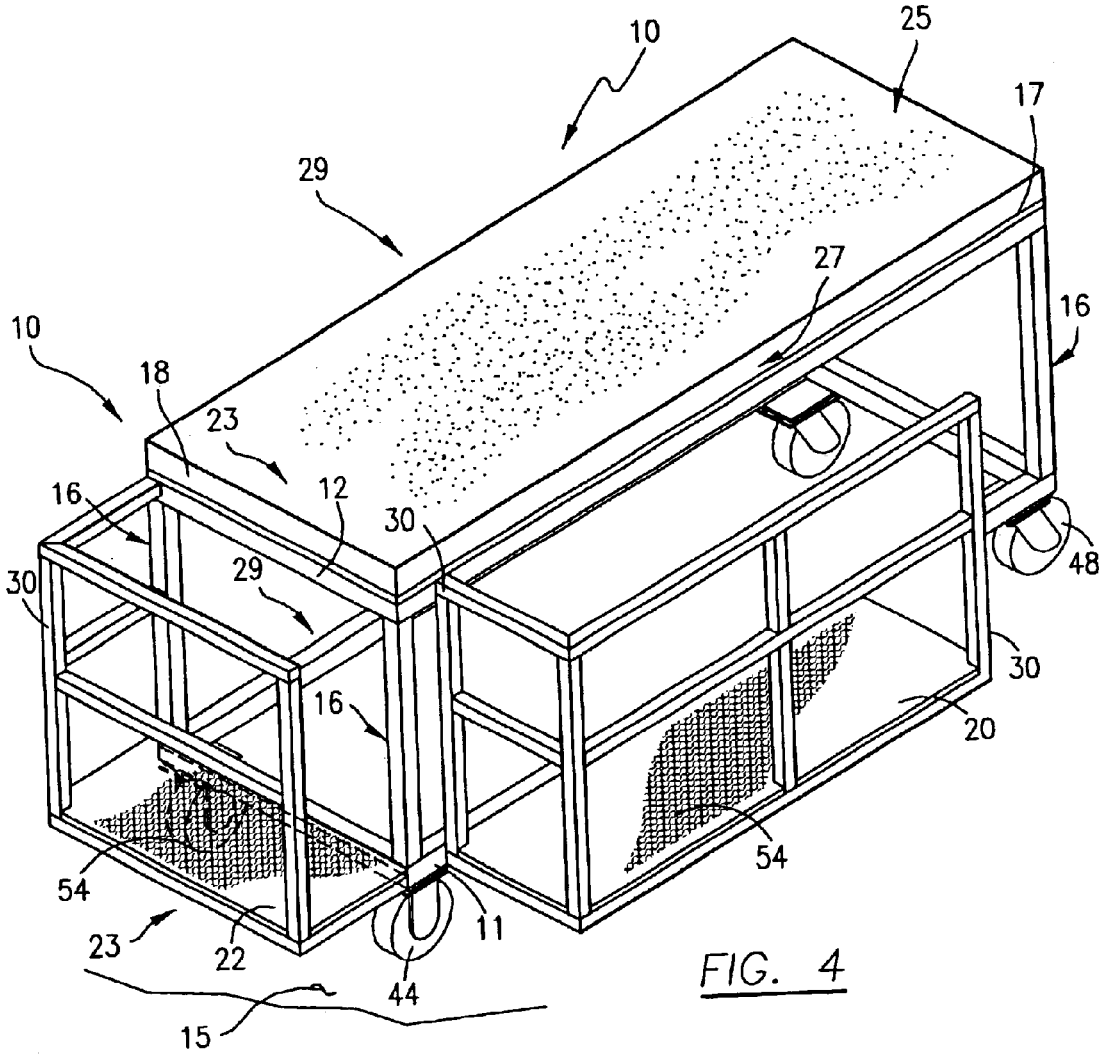
FIG. 4 shows a perspective view of an alternate embodiment of the present invention which correlates to FIG. 1 in the preferred embodiment. When constructed in this alternate embodiment, the two platform sections are attached to and protruding from the lower frame (instead of being part of the lower frame as in the preferred embodiment), one from the side and one from the first end of the lower frame.

In the alternate embodiment as shown in FIG. 4, the lower frame 11 has similar dimensions as the upper frame 12 and the patient support deck 17, or may be smaller or larger in dimension than the upper frame 12 and patient support deck 17.

Figure 4A:
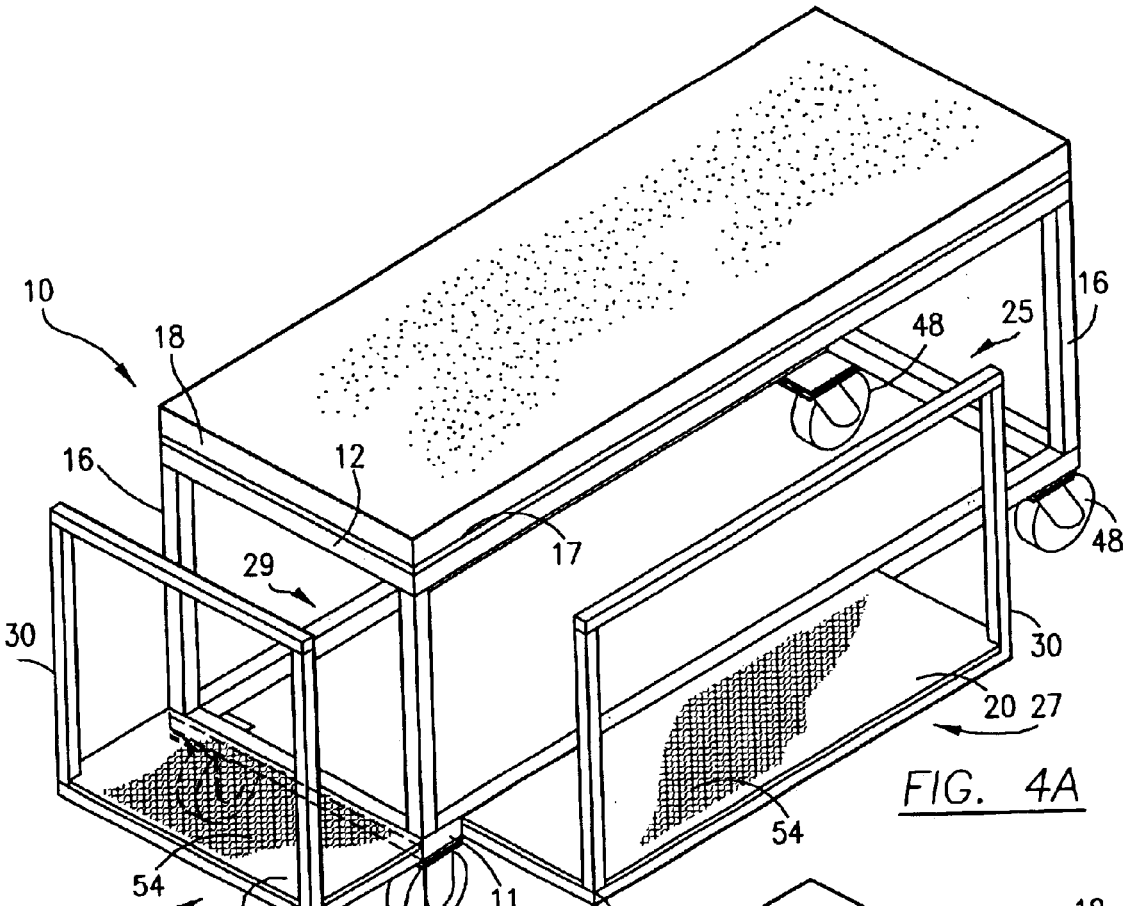
FIG. 4A shows a prospective view of the alternate embodiment of the present invention in a very basic configuration, which correlates to FIG. 1D in the preferred embodiment.
Figure 4B:
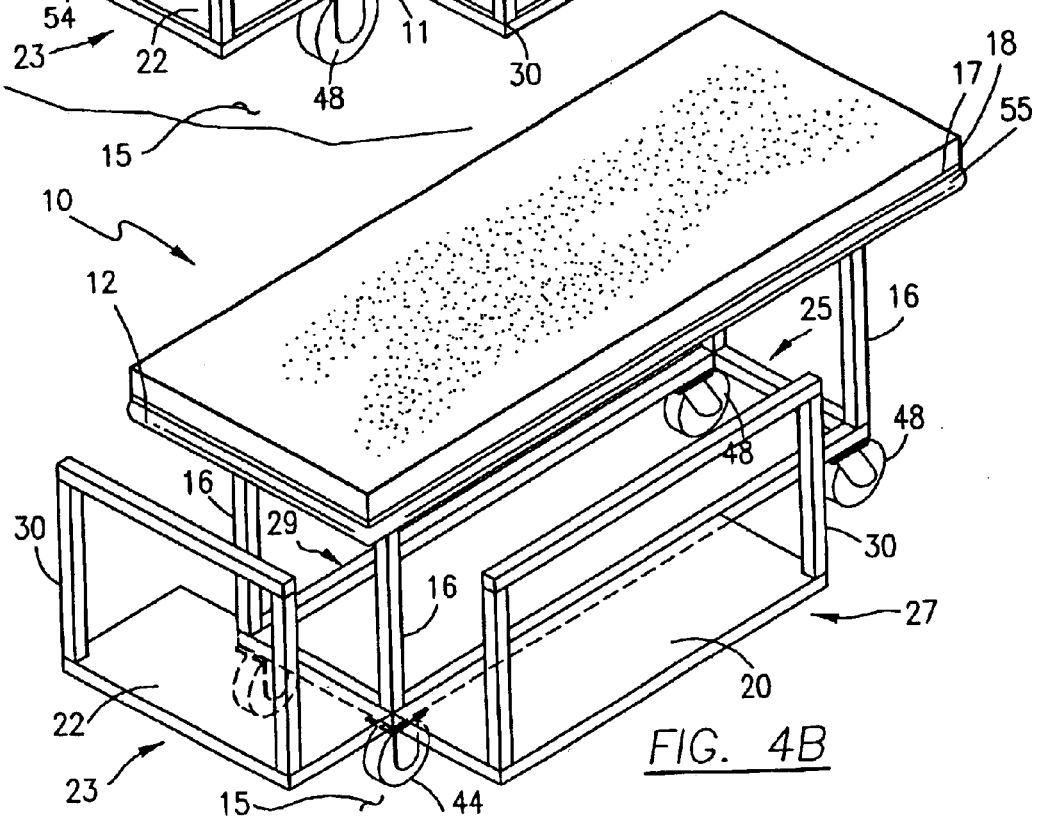
FIG. 4B is another perspective view of a variation of the alternate embodiment of the present invention wherein the lower frame is smaller in dimension than the upper frame, and the wheels are attached to the lower frame underneath the periphery of the upper frame as opposed to being at the four corners of the outside periphery of the assembly.
Figure 4C:
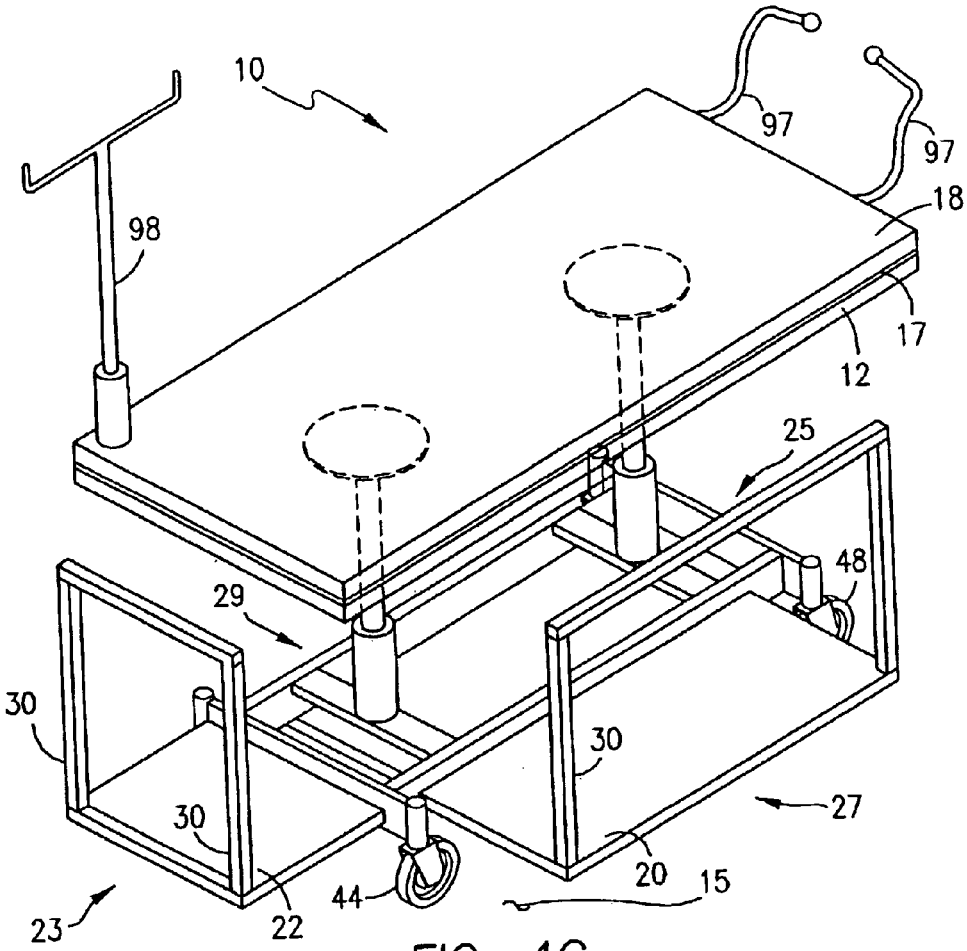
FIG. 4C is a perspective view of another variation of the alternate embodiment of the present invention wherein a the upper frame is mounted on a center support that consists of two strategically placed vertical support members which can either be fixed or adjustable in height by mechanical, electrical, hydraulic or other means. Steering handles can be added at one end of the assembly to assist in the pushing and steering of the assembly while in use, and a pole can be added at the first end of the assembly for hanging IV fluids.

FIG. 4A shows a very basic configuration of the alternate embodiment with safety railings 30 that are attached only to the attendant support platforms 20 and 22, and without any added features. FIG. 4B shows a configuration of an alternate embodiment with wheels 44 and 48 attached to the lower frame 11 within the confines of the lower frame 11 away from the outer edges as opposed to being at the four corners as shown in other configurations. In FIG. 4C the upper frame 12 is mounted on a center support that consists of two strategically placed vertical support members 16 which can either be fixed or adjustable in height by mechanical, electrical, hydraulic or other means.

Figure 5:
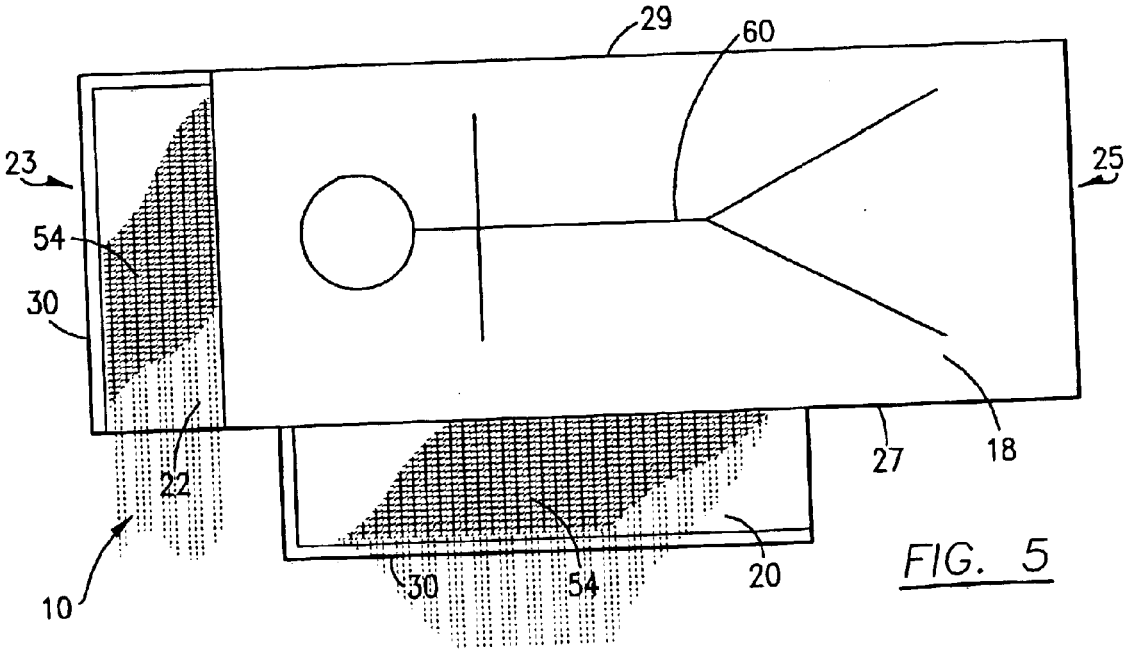
FIG. 5 shows a top plan view of the alternate embodiment shown in FIG. 4.
Figure 6:
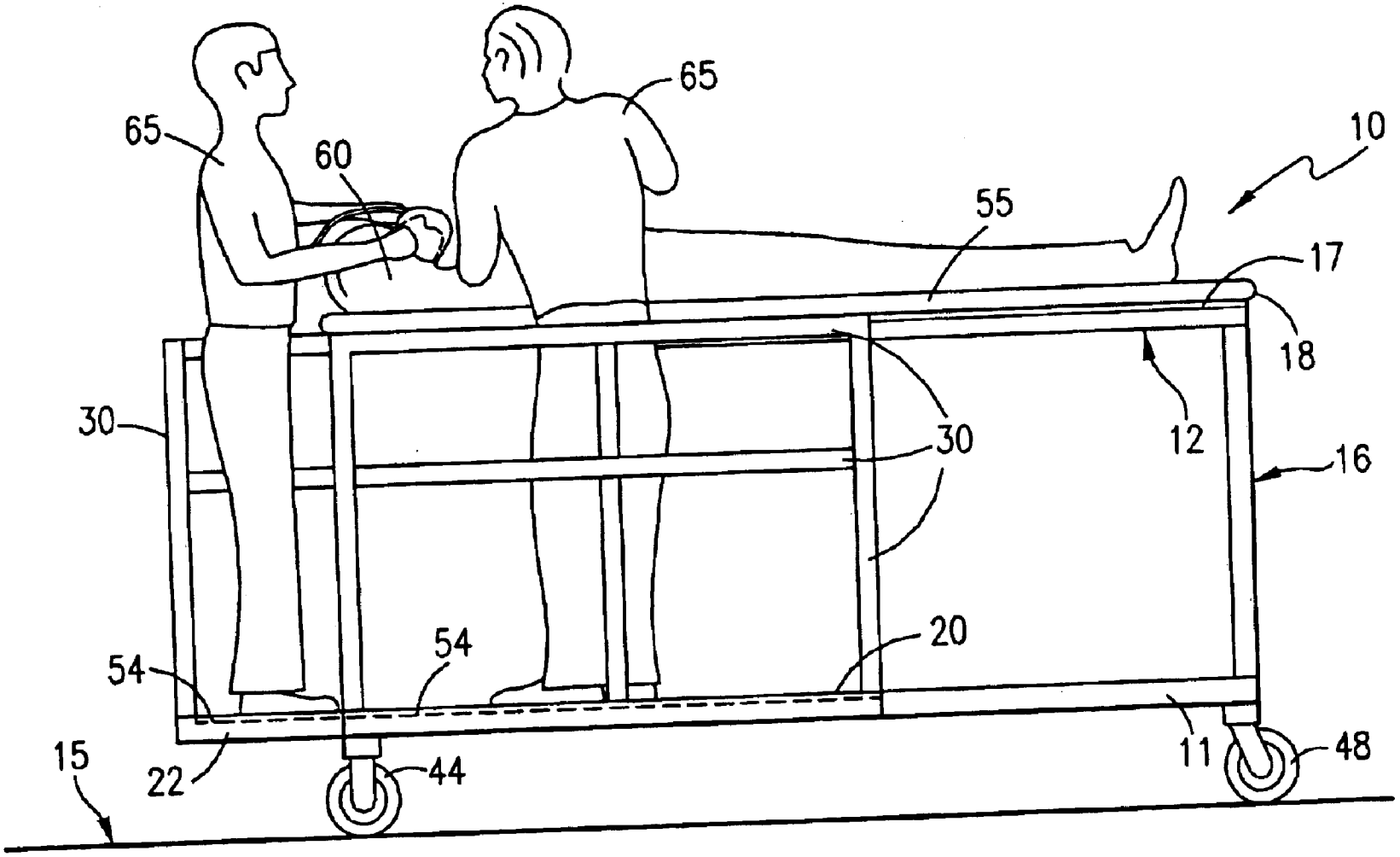
FIG. 6 shows a side elevational view of the alternate embodiment shown in FIG. 4 in use while the assembly, the patient, and attendants rendering medical treatment to the patient are being wheeled to an area of treatment.

FIG. 4C also shows how this or other embodiments can be equipped with steering handles 97 at one end of the assembly 10 to facilitate attendants in the pushing and steering the assembly while in use, and how a pole 98 can be placed at the first end of the assembly for hanging containers to dispense IV fluids to the patient. FIG. 5 shows a top view of this alternate embodiment as shown in FIG. 4 and FIG. 6 shows a view of this alternate embodiment in use.

In the alternate embodiment illustrated in FIG. 4, the rigid attendant support platforms 20 and 22 are attached to and emanate from the lower frame 11 along the first elongated side 27 and at the first end 23 of the assembly 10. Both attendant support platforms 20 and 22 extend laterally beyond the periphery of the lower frame 11 and upper frame 12, and are shown in an embodiment in which they are fixed in position.

As with the preferred embodiment, in this alternate embodiment each attendant support platform 20 and 22 is constructed to accommodate the weight and physical dimension of one or two adult attendants, and may occupy the entire length and width of the first elongated side 27 and first end 23 respectively, or may occupy only a portion of the length and width of the first elongated side 27 and first end 23. As with the preferred embodiment, the attendant support platform 20 may be placed on the second elongated side 29 so that both attendant support platforms 20 and 22 are located opposite each other along part or all of the two elongated sides 27 and 29; a tread or friction-inducing surface 54 may be added to the upper surface of the attendant support platforms 20 and 22; and padding 55 may be added to the upper frame 12 above each attendant support platform 20 and 22.

In the alternate embodiments, each attendant support platforms 20 and 22 include safety railings 30 attached at one or more points to the upper frame 12 and/or the lower frame 11 and the vertical supports 16 which are placed along the outermost longitudinal edge of the attendant support platforms 20 and 22.

Guard rails can be attached to the upper frame 12 of the assembly 10 along the two elongated sides 27 and 29 in the vicinity of the patients shoulders and arms, and can be fixed, removable, foldable or collapsible.

Numerous configurations of alternate embodiments of the invention can be constructed with attendant support platforms 20 and 22 and safety railings 30 that fold, telescope, collapse, retract or are otherwise removable in order to save space when the assembly is not being used.

The attendant support platforms 20 and 22 are selectively disposed in a position generally perpendicular to the floor and planarly adjacent the lower frame 11 and sides 27 and 29 and ends 23 and 25 of the assembly 10 during periods of non-use, and can be conveniently deployed for use.

FIGS. 7A1 and 7A2 show a side view of the attendant support platform 20 and safety railings 30 looking from the first end 23. In this configuration, the attendant support platforms 20 and 22 fold from the in-use horizontal position shown in 7A1 to a position shown in FIG. 7A2, substantially perpendicular to the floor 15. FIG. 7A3 is a view of the assembly showing how the attendant support platform frames 57 and 59 slide parallel to the floor surface in a horizontal arrangement within tubular frames 11*a* and 11*b* mounted in abutting arrangement under and over the lower frame 11 of the assembly 10 such that the tubular beams 11*a* and 11*b* accommodate the full length of the platform frame beams 57 and 59. The safety railings 30 lay adjacent and flush against the upper frame 12 and lower frame 11 portions of the assembly 10 when in the storage position as shown in FIG. 7A2.

FIGS. 7B1 and 7B2 show a side view of the attendant support platform 22 looking from the first elongated side 27.

The attendant support platform 22 on the first end 23 is configured to hingedly pivot upwardly from an in-use position parallel to the floor surface shown in FIG. 7B1 to a position vertical to the floor surface adjacent and sandwiched between the side of the assembly 10 and the attendant support platform frame 57 and the safety railings 30. The upper part of the safety railing 30 detaches from the upper frame, and the attendant support platform frame hinges 70 and 71, and the safety railing hinge 72 allow rotation of the attendant support platform frame 57 and safety railing members 30 to the shown vertical position in FIG. 7B2.

FIGS. 7B3 and 7B4 show a side view of the attendant support platform 20 looking from the second end 25. In this configuration, the attendant support platform 20 slides underneath the assembly 10 and the attendant support platform frame 59 telescopically slides within a separate tubular frame 11A situated below the lower frame 11 of the assembly 10 while the safety railing detaches from the upper frame and the safety railing hinge 72 allows rotation of the safety railing members to the shown vertical position in FIG. 7B4.

In FIGS. 7C1, 7C2, and 7C3, show a top view of the attendant support platform 22 and attendant support platform frame 59 telescopically sliding into the tubular beam 11B above the lower frame 11 of the assembly 10. The horizontal upper safety railings 30 hingedly fold sideways, parallel to the floor surface, using hinges 73 and 74 into a position adjacent and abutting the upper frame 12. The protruding end of the safety railing 75 telescopes within safety railing 30 so as to be flush with the width of the assembly.

In yet another configuration of an alternate embodiment shown in FIGS. 7D1 and 7D2, the safety railings 30 do not make contact with the lower attendant support platform frames 57 and 59, and the safety railing 30 telescopes into the upper frame 12 of the assembly 10 while the attendant support platforms 20 and 22 (shown in phantom) hinge and fold up against the first end 23 and first elongated side 27, and the attendant support platform frame portions 57 and 59 telescope within separate tubular frame portions 11A and 11B situated above 11B and below 11A the lower frame 11 of the assembly 10. The standing surfaces of the attendant support platforms 20 and 22 in this embodiment are shown in phantom in planar lateral abutment in FIG. 7D2 as folded up against the assembly 10 in storage mode. While the embodiment in FIGS. 7D1 and 7D2 is shown with a safety railing 30 that has no vertical members, this configuration can also be constructed with a safety railing that has a vertical member 30*a* as shown in FIGS. 7D3 and 7D4. In FIG. 7E1 the safety railings and attendant support platforms are constructed and attached to the assembly 10 they can be detached from the assembly 10 for storage purposes. Releasable mechanisms are used to hold the safety railings 30 and attendant support platforms 20 and 22 in place while in use, and to facilitate easy removal. While FIG. 7E1 illustrates one method of attaching and removing the attendant support platforms 20 and 22 and safety railings 30, many other methods can be utilized for this purpose.

While the methods shown in the FIG. 7 series and discussed above are the preferred methods for disposing the attendant support platforms 20 and 22 and safety railings 30 to save space for storage of the assembly, any means of folding, hinging, telescoping, retracting or removal can be employed for this purpose.

Figure 8A:
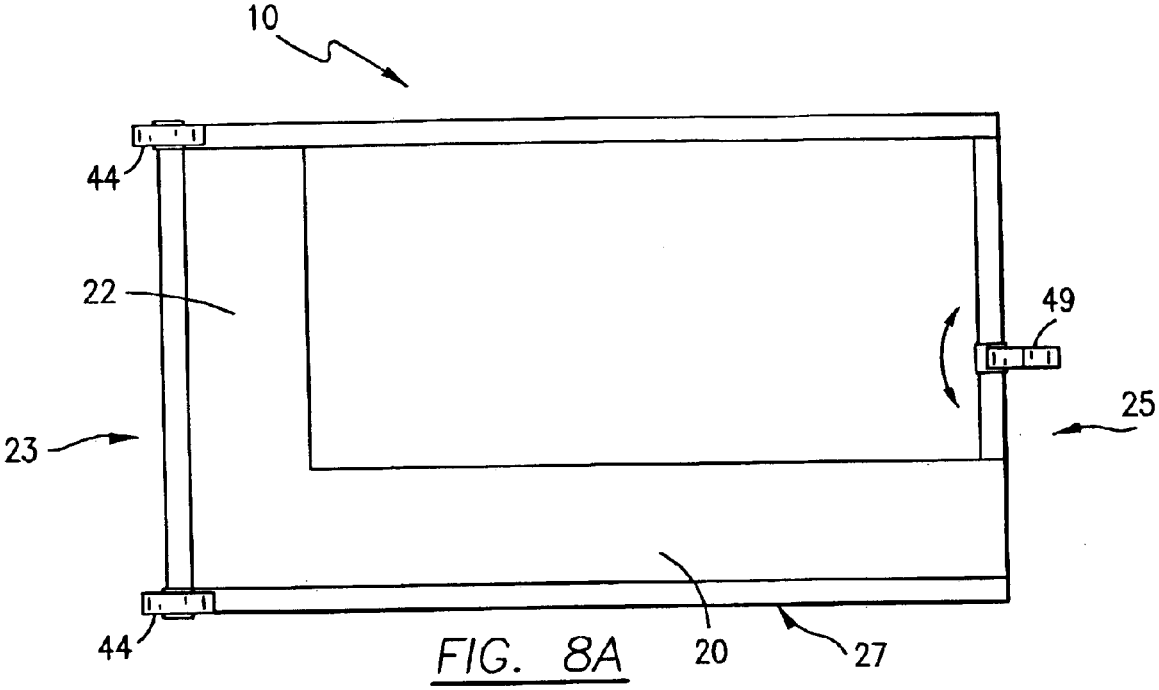
FIG. 8A shows a bottom plan view of the preferred embodiment with the lower frame of the assembly having a singular swivel wheel on the second end.
Figure 8B:
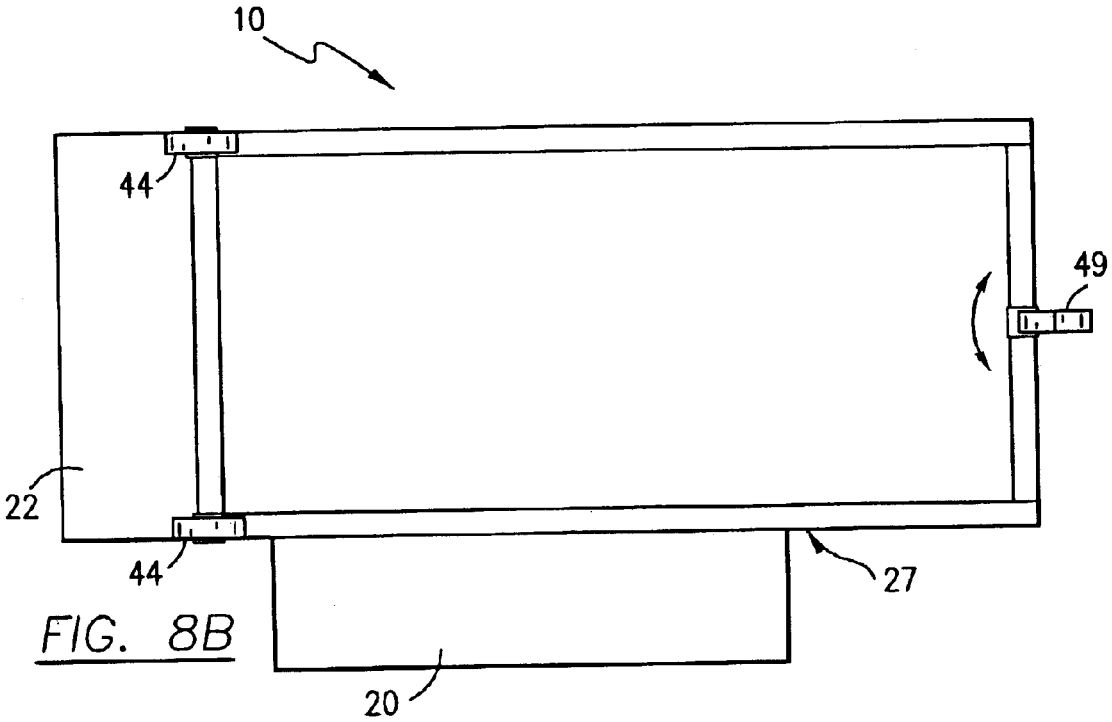
FIG. 8B shows a bottom plan view of an alternate embodiment with the lower frame of the assembly having a singular swivel wheel on the second end.

FIGS. 8A and 8B show alternate embodiments where the assembly has two first end 23 preferably rotatable wheels 44 and only one at the second end 25 preferably swivelable wheel 49.

Vertical stability of the assembly is critical to safe operation and use. Therefore, in addition to or in place of constructing the assembly 10 to be stable, other methods for supporting or offsetting the weight of the attendants and enhancing vertical stability of the assembly can be added to the attendant support platforms or built into the assembly. The following FIGS. 9 and 10 series illustrate methods for accomplishing this objective.

Figure 9:
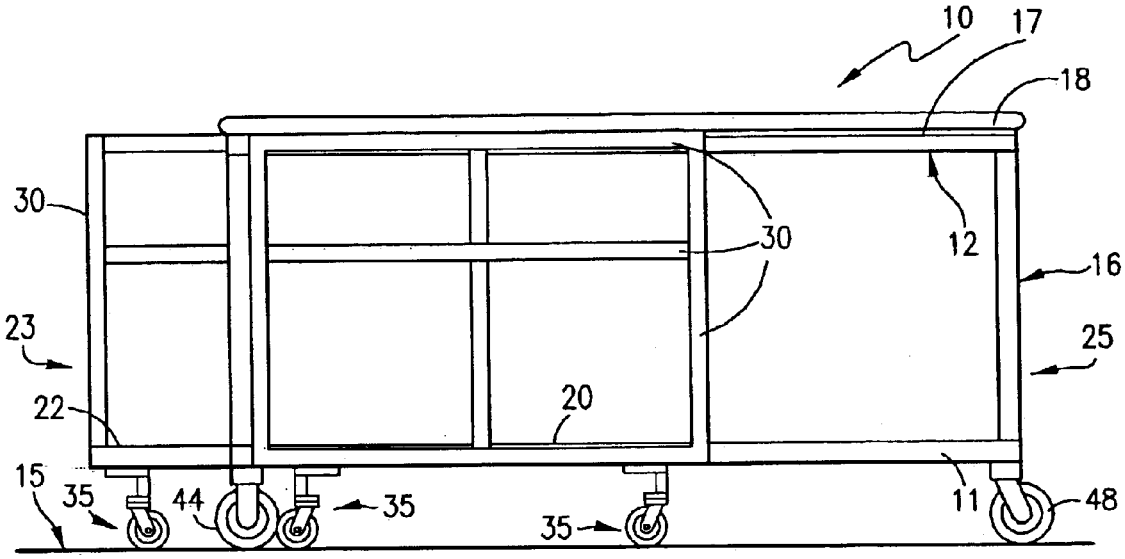
FIG. 9 shows a side elevational view of another alternate embodiment having one or more swivel wheel assemblies disposed underneath each attendant support platform 20 and 22 to prevent the assembly from tipping or becoming unstable the attendants are standing on the attendant support platforms 20 and 22.
Figure 9A:
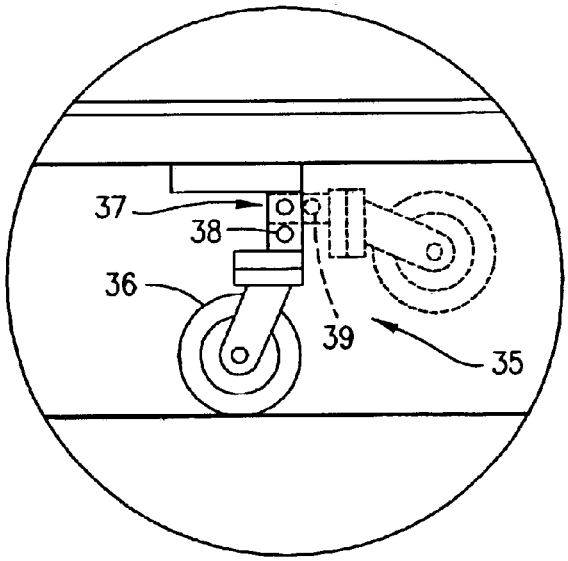
FIG. 9A shows a partially cut away underside bottom side elevational view of the swivel wheel assembly 35 in FIG. 9 in a configuration in which the swivel wheel 36 can be folded and retracted up against the underside of the attendant support platforms 20 and 22.

In FIG. 9, one or more swivel wheels and supports assemblies 35 can be added to the bottom of the attendant support platforms 20 and 22 for weight and balance reinforcement to support the weight of the attendants and provide vertical stability for the assembly. These swivel wheels can be fixed as shown in FIG. 9, or in embodiments where the attendant support platforms telescope or fold, a spring-like, friction-engaged button 39 and corresponding opening 38 on the wheel bracket 37 activates both the retraction and downward in-use placement position of the swivel wheel 36 as shown in FIG. 9A. This spring-actuated friction button is well-known in the art, operates easily for manual activation, and is a simplified, space-saving construction.

While swivel wheel assemblies 35 are the preferred means for placing under the attendant support platforms 20 and 22 for providing weight reinforcement and enhancing the stability, any means that will move freely across the floor surface while supporting the attendant support platforms 20 and 22, including castors or skid pads can be utilized for this purpose.

Another method to offset the weight of the attendants and enhance vertical stability is to employ one or more counter weights 90 as shown in FIG. 10A (side view) and 10B (bottom view). Ideally, these counter weights should be constructed of lead, iron or steel, although any other heavy metal or material such as concrete can be used. They can be attached or built into the lower frame or other parts of the assembly in strategically placed locations where they will help to offset the weight of the attendant(s) standing on the attendant support platforms 20 and 22.

Figure 11A:
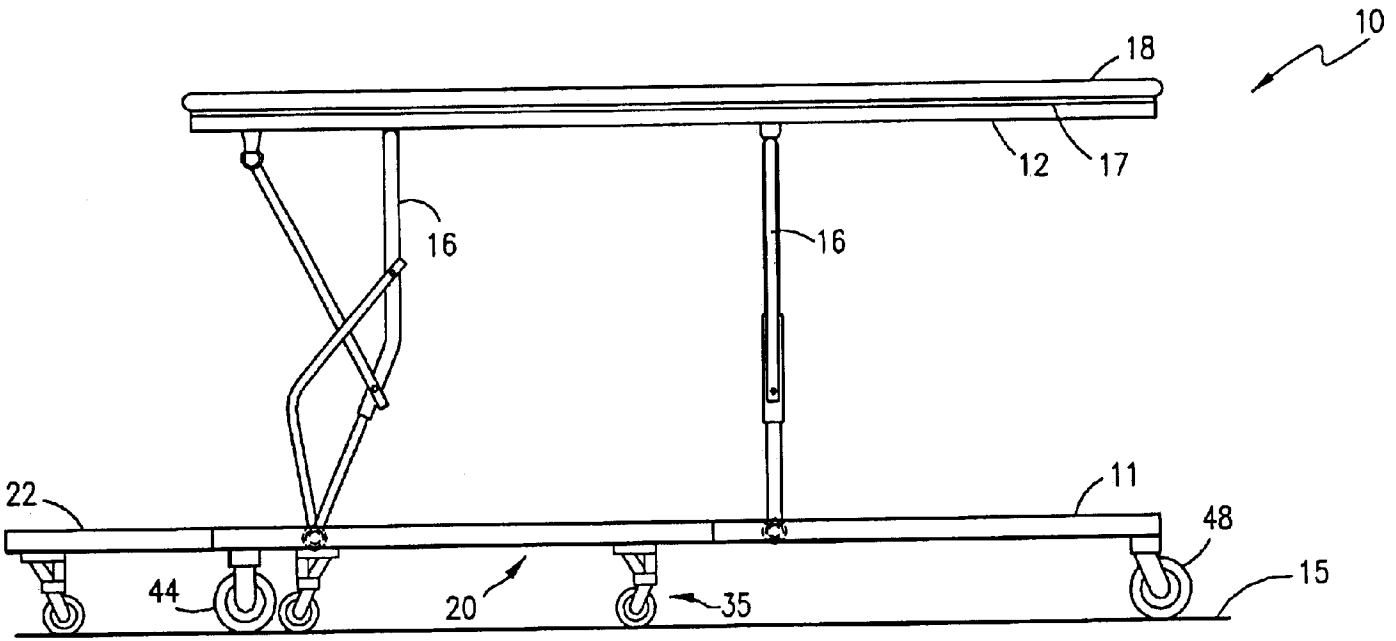
FIGS. 11A and 11B show yet another alternate embodiment in side elevational views in which the vertical supports are collapsible together with the retractable attendant support platforms and safety railings, so that the upper and lower frames can be folded together to save space, similar to the methods used with ambulatory stretchers on ambulances.
Figure 11B:
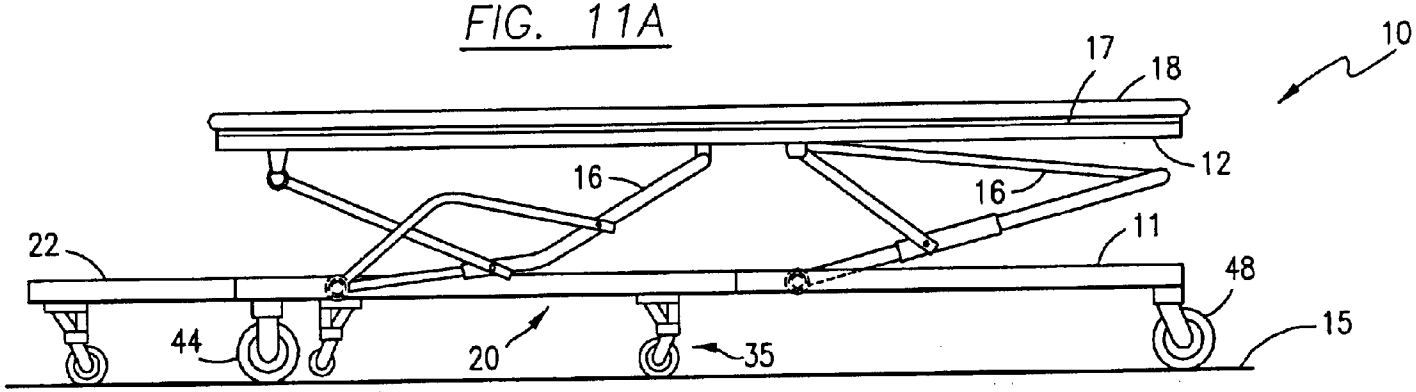
Figure 11C:
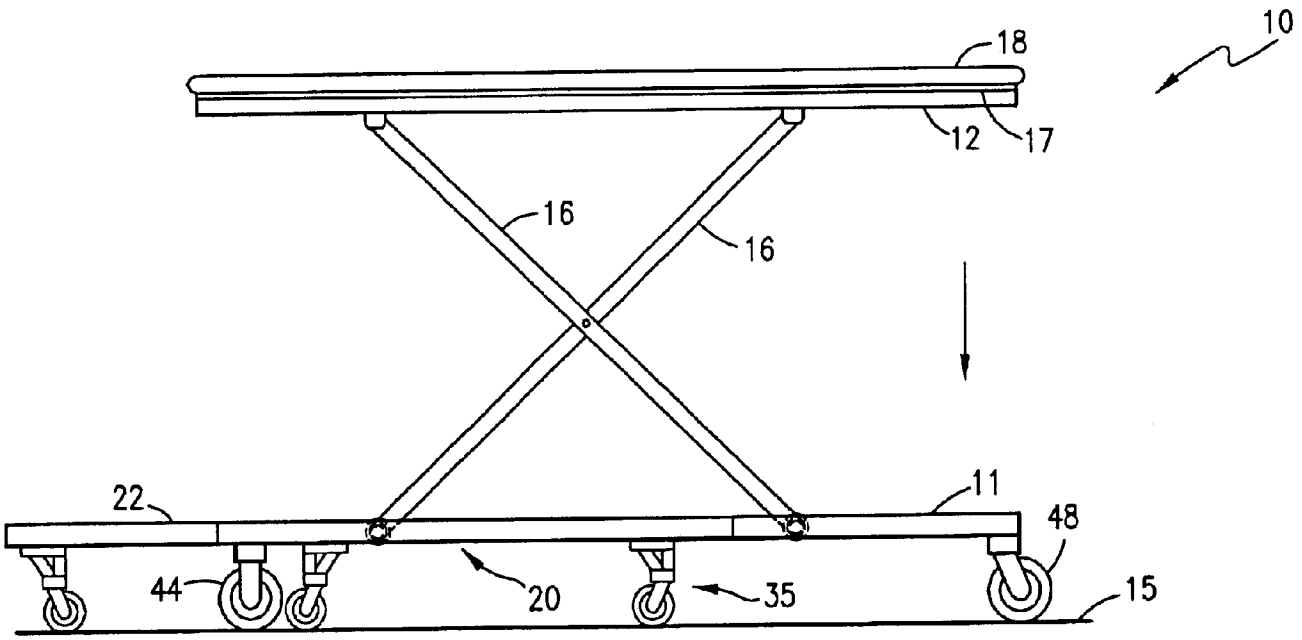
FIGS. 11C and 11D show side elevational views of a similar alternate embodiment with a different structure for collapsing the vertical supports to allow the upper and lower frames to be folded together.
Figure 11D:
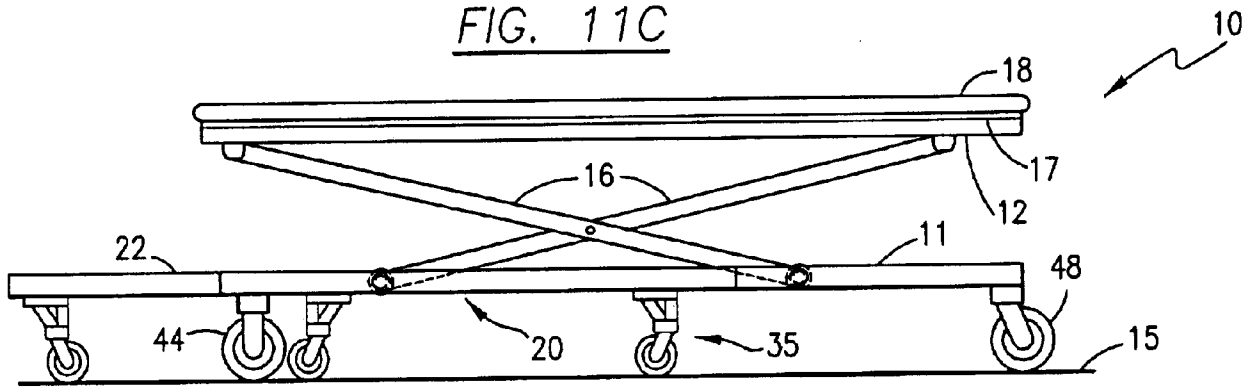

In the alternate embodiments in which the attendant support platforms and safety railings collapse, fold, telescope or otherwise retract, the vertical support railings can also collapse or fold so that the upper and lower frames can be brought together in a manner like or similar to an ambulatory stretcher used in ambulances where the upper frame and patient support surface can be raised or lowered from the lower frame. FIGS. 11A and 11B show a variation of the invention so constructed FIGS. 11C and 11D show a different method for collapsing the structure. In the variation shown in FIG. 9, swivel wheels have been employed underneath the attendant support platforms 20 and 22 for stability; however, other methods as discussed throughout can be employed for this purpose.

Figure 12:
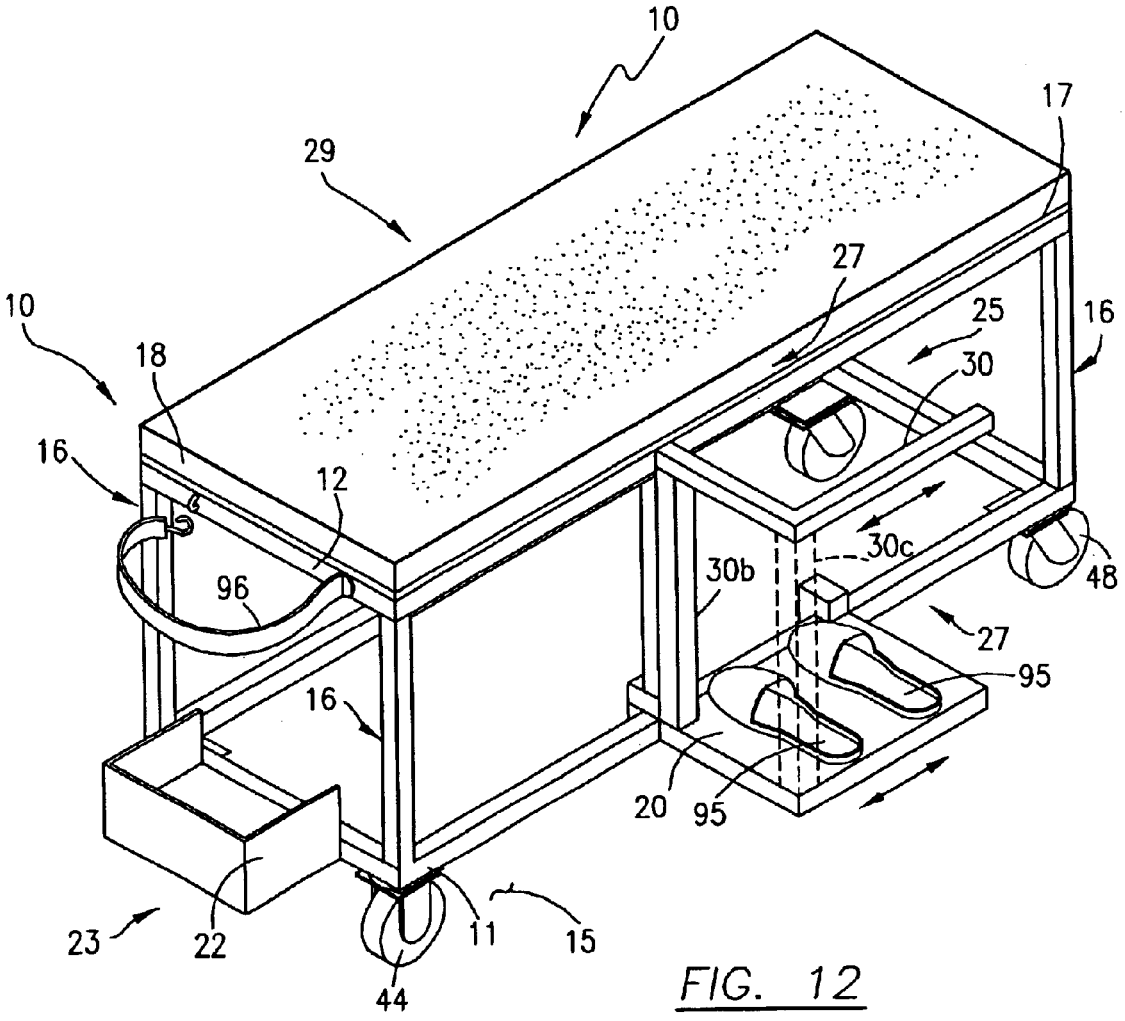
FIG. 12 shows a perspective view of the assembly to illustrate alternate means and methods for constructing and configuring the attendant support platforms and safety railings.

While attendant support platforms like those shown as 20 and 22 throughout the figures and safety railings like those shown as 30 throughout the figures are the preferred method for supporting the attendants and preventing them from falling, other means can also be utilized for this purpose. FIG. 12 shows two such means. Along the first side 27, an attendant support platform 20 with built-in footholds 95 that is just large enough to accommodate one attendants feet is attached to the lower frame 11. A safety rail 30 protrudes from the upper frame and is connected to the attendant support platform 20 by a vertical member 30*b*, which can also be located at the outboard corner shown as 30*c* in phantom. The attendant support platform 20 and safety railing 30 can be fixed in a stationary position so the attendant can stand adjacent to the patients upper torso (in which case the vertical member 30*b* can be eliminated), or they can slide back and forth along the upper frame 12 and lower frame 11. Various means for sliding a part along a horizontal member are well known in the art and need not be discussed in detail here. When such sliding means are employed, means for preventing the attendant support platform 20 and/or footholds 95 and safety railing 30 from moving while in use need to be employed. Such means are also well known in the art and need not be discussed further here. In other configurations not shown here, footholds 95 alone can be utilized in place of the attendant support platform 20 with integrated footholds 95, or a small attendant support platform without footholds 95 can be utilized as well. In other configurations the vertical member 30*b* connecting the safety railing 30 and attendant support platform 20 or footholds 95 can be eliminated so the two slide along the upper frame 12 and lower frame 11 independently. Also shown in FIG. 12 at the first end 23 of the assembly 10 is a different means of supporting and securing the attendant. A small attendant support platform 22 is attached to the lower frame. This attendant support platform 22 has raised edges around the three outboard sides to prevent the attendants feet from moving beyond the edge, thereby preventing the attendants feet from coming off the attendant support platform while the assembly is in use. A strap or metal restraint 96 takes the place of a safety railing and is fixed to one point on the upper frame 12, and can be clipped or otherwise attached to another point on the upper frame 12. The attendant can then step onto the attendant support platform 22, wrap the restraint 96 around his or her body, and attach it to the upper frame 12. Like the safety railings 30 shown throughout, the restraint 96 is used to provide a point of balance for the attendant and keep the attendant from falling off the assembly 10 while it is in use. This restraint 96 can take various forms, including that of a harness, belt, strap or other means of restraint, all of which can be used to keep the attendant from falling.

Referring to the preferred embodiment in FIG. 3, in the practice of this invention, when an emergency condition arises which necessitates a patient being quickly stabilized and simultaneously moved to an area of treatment, as in moving an arrested patient to surgery while simultaneously performing CPR, the patient 60 is placed on the horizontal patient support deck 17 or patient support surface 18 of the assembly 10 while one or more medical attendants 65 stand on the attendant support platforms 20 and 22 disposed in a position for rendering emergency treatment. Such emergency treatment, e.g., bagging, inserting of IV lines, administering CPR can be performed by the attendant(s) 65 standing on the attendant support platform(s) 20 and 22 and the patient 60 can be moved simultaneously and without interruption of emergency and potentially life-saving treatment, while being wheeled by one or more other attendants (not standing on a platform and not shown in the drawings) to the desired area of treatment such as an operating room. Upon arrival, the patient 60 can be treated on the assembly 10, but in most instances will be removed from the assembly 10 and placed on an appropriate surface like an operating table for continued emergency treatment. For example, with the instant invention, patients that could not otherwise be moved at the time, (e.g., a situation in which emergency treatment cannot be stopped for more than a few seconds such as with a patient in cardiac arrest, or severe trauma), can be taken to the desired area of treatment without undue delay and simultaneous with the administration of CPR or other potentially life saving emergency treatment. In addition to the benefits to the patient 60, the attendants 65 treating the patient 60 during this wheeling need not be concerned with running alongside the assembly, nor with avoiding or encountering floor or hallway obstacles, nor are the attendants exposed to great risk of falling from or slipping on the platforms on which they stand due to the existence of the safety railings 30, and the attendants can continue to render treatment (such as CPR) which could not be continued if the attendants had to run alongside the patient as on conventional stretchers. Accordingly, an attendant 65 standing at the head or alongside of the patient 60 will be able to devote substantially his or her entire attention to treating the patient 60 while one or more other attendants need only be concerned with quickly pushing, pulling and steering the assembly 10 to the appropriate area of treatment. The patient 65 is treated during transport rather than prior to transport to the ultimate treatment destination, (e.g., operating room), saving valuable and potentially life-saving minutes in the process. In addition, in a number of variations, the attendant support platforms and safety railings may be retracted by various means to be stored when not in use, thereby saving space. A number of desirable features can be added, for example a traction surface 54 on the upper surface of the attendant support platforms to help prevent slippage of the attendants, padding 55 to provide comfort for the attendants, guard rails 56 to prevent the patients arms from falling off the patient support deck 17 or patient support surface 18 thereby preventing the patients arms from interfering with the attendant. Additional features like mechanisms for adjusting the height of the upper frame 12, patient support deck 17 and patient support surface 18 can be added as shown in FIGS. 1G and 4C can be built into the assembly, and steering handles 97 and IV poles 98 can be added as shown in FIG. 4C. The instant invention can be constructed with any number or combinations of features and configurations as discussed herein.

The instant invention has been shown and described herein in what is considered to be the most practical and preferred embodiments, with configurations and features that are believed to be useful. It is recognized, however, that departures may be made therefrom within the scope of the invention and that obvious modifications will occur to a person skilled in the art.

What is claimed is:

1. A mobile patient support assembly to safely support and transport a patient and at least one medical attendant for administering medical assistance to the patient while the patient support assembly is being moved comprising:

means for supporting the patient;

means for supporting and moving said assembly over the surface, such means being constructed and positioned so that said assembly is stable and does not lean, tip or otherwise become unstable while in use;

means for supporting at least one attendant in a standing position located on at least one side of said assembly, such means being placed so that said attendant(s) are in a position suitable for administering medical assistance to the patent while the attendant(s) are standing on such supporting means; and means to prevent the standing attendant(s) from falling off said attendant supporting means, said means positioned behind the standing attendant(s).

2. A mobile patient support assembly to safely support and transport a patient and at least one medical attendant for administering medical assistance to the patient while the patient support assembly is being moved comprising:

a patient support surface;

means for supporting and moving said assembly;

means for supporting at least one attendant in a standing position located on at least one side of said assembly so that said attendant(s) are in a position suitable for medical assistance to the patent while the attendant(s) are standing on such supporting means, said supporting means being placed within the structure of the means for supporting and moving the assembly so that said assembly is stable and does not learn, tip or otherwise become unstable when attendant(s) are standing on said attendant support means; and means to prevent the standing attendant(s) from falling off said attendant support means, said means being positioned behind the standing attendant(s).

3. A mobile patient support assembly to safely support and transport a patient and at least one medical attendant for administering medical assistance to the patient while the patient support assembly is being moved comprising:

a patient support surface;

means for supporting and moving said assembly;

means for supporting at least one attendant in a standing position attached to at least one side of said assembly so that said attendant is in a position suitable for administering medical assistance to the patent while the attendant(s) are standing on such means;

means to prevent the standing attendant(s) from falling off said attendant support means positioned behind the standing attendant(s); and means for maintaining the stability of said assembly to prevent it from leaning, tipping over or otherwise becoming unstable while in use.

4. A mobile patient support assembly to safely support and transport a patient and at least one medical attendant, for administering medical assistance to the patient while the patient support assembly is being moved, comprising:

a rectangularly shaped upper frame including a rigid, horizontally supported, planar patient support surface;

a rectangularly shaped lower frame which is longer and wider than the upper frame and patient support surface;

at least one rigid vertical support member to connect said upper frame to said lower frame, said upper and lower frame being positioned in relation to each other so that one side one end of the lower frame protrudes beyond the outer edges of the upper frame and patient support surface;

a plurality of rolling mechanisms attached underneath the lower frame and making contact with the floor surface for moving said assembly over the floor surface, such rolling mechanisms being positioned to maintain the stability of said assembly while it is in use;

at least one attendant support platform located on the side or end of the lower frame that protrudes beyond the outer edges of the upper frame and patient support surface, such attend support platform being sized and positioned to allow at least one standing attendant to administer medical assistance to the patient while standing on such attendant support platform, said attendant support platform further being positioned substantially within the perimeter of said lower frame and rolling mechanisms to so as to maintain the stability of said assembly while it is in use; and at least one rigid member attached to said assembly located in proximity to each attendant support platform, said rigid member being designed and positioned behind the standing attendant(s) to prevent the standing attendant(s) from falling off the assembly and to allow the attendants(s) to mount and dismount the assembly with minimal difficulty.

5. A device as in claim 4 wherein the rolling mechanisms are comprised of wheels, swivel wheels or castors.

6. A device as in claim 4, wherein the rolling mechanisms is arms comprised of a combination of wheels and swivel wheels, wheels and castors, or swivel wheels and castors.

7. A device as in claim 4 with two attendant support platforms located at the side and end of the assembly where the lower frame protrudes beyond the outer edges of the upper frame and patient support surface.

8. A device as in claim 4 wherein the standing surface of said attendant support platform(s) are covered with a non-skid surface.

9. A device as in claim 4 wherein the patient support surface includes a pad for patient comfort.

10. A device as in claim 4 wherein said assembly includes means to prevent the patient or the patient's arms from falling off the patient support surface or otherwise interfering with the attendant(s).

11. A device as in claim 4 wherein said assembly includes padding attached to the upper frame or patient support surface in proximity to the attendant support platform(s) so as to provide padding for the standing attendant(s).

12. A device as in claim 4 wherein said upper frame and patient support surface and said lower frame are connected by a mechanism that allows the vertical position of the patient support surface to be adjusted manually, hydraulically, or electrically.

13. A device as in claim 4 wherein said upper fame and patient support surface and said lower frame are connected by a mechanism that collapses so that the upper frame and patient support surface can be brought closer to the lower frame in order to reduce the vertical space used by the assembly.

14. A device as m claim 4 where more than one rigid member is employed to prevent the standing attendant(s) from falling off the assembly, such rigid members being attached at one or more points about the assembly including the upper frame, lower frame, attendant support platform and/or patient support surface.

15. A mobile patient support assembly to safely support and transport a patient and at least one medical attendant, for administering medical assistance to the patient while the patient support assembly is being moved, comprising:

a rectangularly shaped upper frame including a rigid, horizontally supported, planar patient support surface;

a rectangularly shaped lower frame which is substantially similar in length and width to the upper frame and patient support surface;

at least one rigid vertical support member to connect said upper frame to said lower fame;

a plurality of rolling mechanisms attached underneath the lower frame and making contact with the floor surface for moving said assembly over the floor surface, such rolling mechanisms being positioned to maintain the stability of said assembly;

at least one attendant support platform attached to the lower frame on at least one side or end of the assembly, such attendant support platform sized and positioned to allow at least one standing attendant(s) to administer medical assistance to the patient while standing on such attendant support platform; and at least one rigid member attached to the assembly or to the attendant support platform located in proximity to each attendant support platform, said rigid member being designed and positioned behind the standing attendant(s) to prevent the standing attendant(s) from falling off the assembly and to allow the standing attendant(s) to mount and dismount the assembly with minimal difficulty.

16. A device as in claim 15 wherein the attendant support platform(s) are pivotally connected to said assembly and fold relative to the assembly for storage purposes.

17. A device as in claim 15 wherein the attendant support platform(s) are telescopically connected to said assembly and slide inwardly relative to the assembly for storage purposes.

18. A device as in claim 15 wherein the attendant support platform(s) are removable for storage purposes.

19. A device as in claim 15 wherein the rigid member(s) to prevent the attendant(s) from falling off the attendant support platform(s) are retractably connected to said assembly and fold relative to the assembly for storage purposes.

20. A device as in claim 15 wherein the rigid member(s) to prevent the attendants(s) from falling off the attendant support platform(s) are telescopically connected to said assembly and slide inwardly relative to the assembly for storage purposes.

21. A device as in claim 15 wherein the rigid member(s) to prevent the attendant(s) from falling off the attendant support platform(s) are removable for storage purposes.

22. A device as in claim 15 wherein the rolling mechanisms comprise of wheels, swivel wheels or castors.

23. A device as in claim 15 wherein the rolling mechanisms comprise of a combination of wheels and swivel wheels, wheels and castors, or swivel wheels and castors.

24. A device as in claim 15 with two attendant support platforms located at one side and one end of the assembly.

25. A device as in claim 15 wherein the standing surface of said attendant support platform(s) are covered with a non-skid surface.

26. A device as in claim 15 wherein the patient support surface includes a pad for patient comfort.

27. A device as in claim 15 wherein said assembly includes means to prevent the patient or the patient's arms from falling off the patient support surface or otherwise interfering with the attendant(s).

28. A device as in claim 15 wherein said assembly includes padding attached to the upper frame or patient support surface in proximity to the attendant support platform(s) so as to provide padding for the standing attendant(s).

29. A device as in claim 15 wherein said upper frame and patient support surface and said lower frame are connected by a mechanism that allows the vertical position of the patient support surface to be adjusted manually, hydraulically, or electrically.

30. A device as in claim 15 wherein said upper frame and patient support surface and said lower frame are connected by a mechanism that collapses so that the upper frame and patient support surface can be brought closer to the lower frame in order to reduce the vertical space used by the assembly.

31. A device as in claim 15 where more than one rigid member is employed to prevent the standing attendant(s) from falling off the assembly, such rigid members being attached at one or more points about the assembly including the upper frame, lower frame, attendant support platform and/or patient support surface.

32. A device as in claim 15 wherein the stability of said assembly is maintained by attaching wheels, swivel wheels, castors, or a combination of two or more thereof, underneath the attendant support platform(s) in order to prevent the assembly from leaning, tipping over or otherwise becoming unstable while in use.

33. A device as in claim 15 wherein the stability of said assembly is maintained by attaching skid pads underneath the attendant support platform(s) in order to prevent the assembly from leaning, tipping over or otherwise becoming unstable while in use.

34. A device as in claim 15 wherein the stability of said assembly is maintained by using weights positioned about the assembly to counterbalance the weight of the attendant (s) when they are standing on the attendant support platform (s) in order to prevent the assembly from leaning, tipping over or otherwise becoming unstable while in use.

* * * * *